US009863631B1

(12) United States Patent
Storer

(10) Patent No.: US 9,863,631 B1
(45) Date of Patent: Jan. 9, 2018

(54) SHOE LIGHT DEVICE AND METHOD

(71) Applicant: Douglas R. Storer, Orlando, FL (US)

(72) Inventor: Douglas R. Storer, Orlando, FL (US)

( * ) Notice: Subject to any disclaimer, the term of this patent is extended or adjusted under 35 U.S.C. 154(b) by 359 days.

(21) Appl. No.: 14/214,961

(22) Filed: Mar. 16, 2014

Related U.S. Application Data

(60) Provisional application No. 61/793,594, filed on Mar. 15, 2013.

(51) Int. Cl.

| | |
|---|---|
| ***A43B 3/00*** | (2006.01) |
| ***F21V 33/00*** | (2006.01) |
| ***F21L 4/08*** | (2006.01) |
| ***F21L 4/02*** | (2006.01) |
| *F21Y 101/02* | (2006.01) |
| *F21W 111/10* | (2006.01) |

(52) U.S. Cl.
CPC ..... *F21V 33/0076* (2013.01); *A43B 3/001* (2013.01); *F21L 4/02* (2013.01); *F21L 4/08* (2013.01); *F21V 33/0008* (2013.01); *F21W 2111/10* (2013.01); *F21Y 2101/02* (2013.01)

(58) Field of Classification Search
CPC ..... F21V 21/0885; F21V 33/0076; F21V 33/0008; F21L 4/02; F21L 4/08; A43B 3/001; F21W 2111/10; F21Y 2101/02; A45F 5/02
See application file for complete search history.

(56) References Cited

U.S. PATENT DOCUMENTS

| | | | | |
|---|---|---|---|---|
| 2,671,847 | A * | 3/1954 | Lerch | A43B 1/0036 36/1 |
| 3,067,322 | A * | 12/1962 | Sala | A43B 1/0036 36/137 |
| 6,122,340 | A * | 9/2000 | Darley | G01P 15/08 377/23 |
| 7,200,517 | B2 * | 4/2007 | Darley | A43B 3/0005 36/132 |
| D614,345 | S * | 4/2010 | Bertken | D26/138 |
| 8,550,652 | B2 * | 10/2013 | Tseng | A41D 27/085 362/104 |
| 2003/0021105 | A1 * | 1/2003 | Cramer | F21L 14/00 362/105 |
| 2003/0026093 | A1 * | 2/2003 | Sandberg | F21V 21/0885 362/191 |

(Continued)

*Primary Examiner* — Elmito Breval
*Assistant Examiner* — Fatima Farokhrooz
(74) *Attorney, Agent, or Firm* — Rick B. Yeager

(57) ABSTRACT a light-monitoring apparatus includes a power source, a light detector, a computer processor coupled with the power source and in communication with the light detector and configured to receive and record light exposure detected by the light detector, an output device coupled with the computer processor, and a computer-readable medium coupled with the computer processor and storing instruction code for summing the recorded light exposure from the computer processor over time and communicating a signal to the output device to generate and communicate a signal indicating that a cumulative threshold light exposure for achieving a health benefit has been reached. The apparatus can accordingly be used by an individual to monitor cumulative light exposure from both natural and artificial sources, e.g., in the treatment of seasonal or non-seasonal depression.

15 Claims, 32 Drawing Sheets

(56) References Cited

U.S. PATENT DOCUMENTS

| | | | | |
|---|---|---|---|---|
| 2005/0052883 | A1* | 3/2005 | Qi | A47G 33/06 362/555 |
| 2007/0109768 | A1* | 5/2007 | Sohn | F21S 9/037 362/106 |
| 2007/0130804 | A1* | 6/2007 | Levy | A43B 1/0027 36/136 |
| 2008/0253108 | A1* | 10/2008 | Ellenburg | A43B 1/0036 362/103 |
| 2009/0059607 | A1* | 3/2009 | Yoon | F21L 4/02 362/396 |
| 2013/0215607 | A1* | 8/2013 | Ellenburg | F21V 21/08 362/191 |
| 2013/0301034 | A1* | 11/2013 | Olds | A61N 5/0618 356/51 |
| 2014/0009921 | A1* | 1/2014 | Ancona | F21L 4/005 362/191 |

* cited by examiner

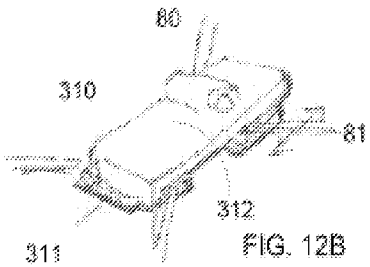
FIG. 12A
FIG. 12B
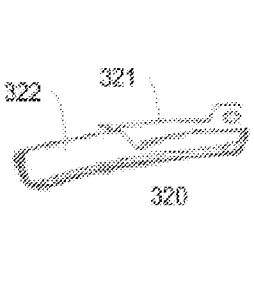
FIG. 13A
FIG. 13B
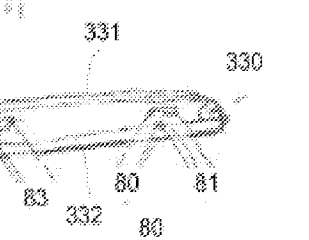
FIG. 14A
FIG. 14B
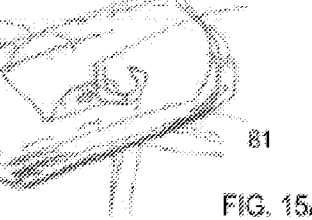
FIG. 15A
FIG. 15B

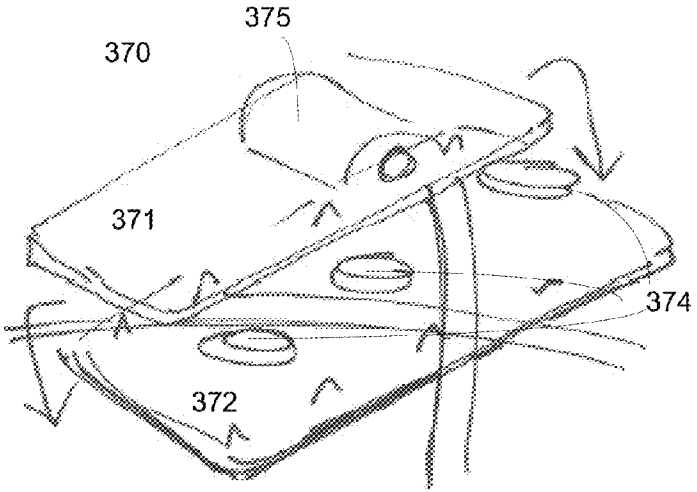
FIG. 18
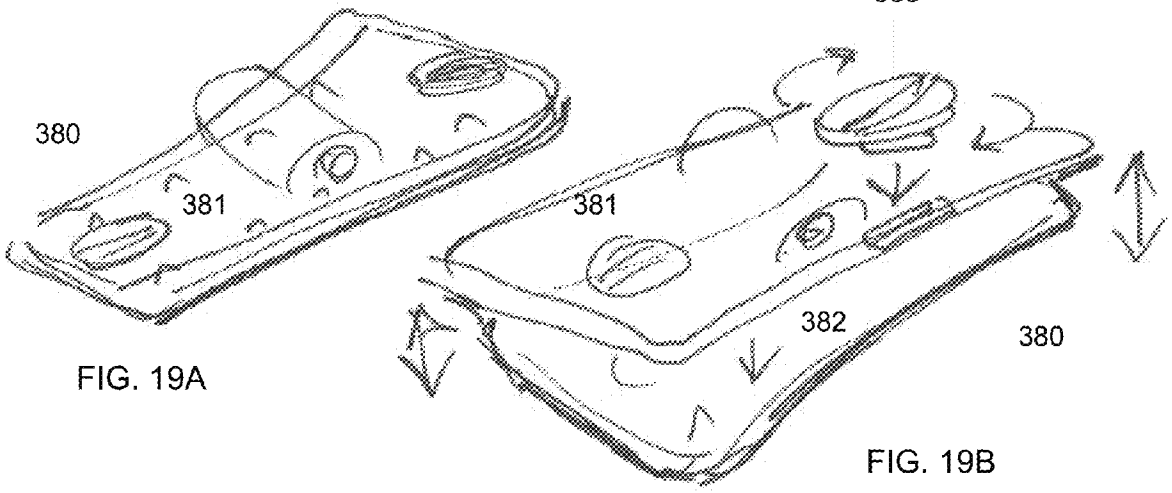
FIG. 19A
FIG. 19B

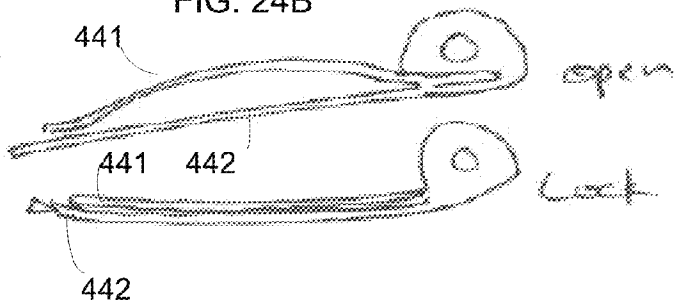
FIG. 24B
FIG. 24C
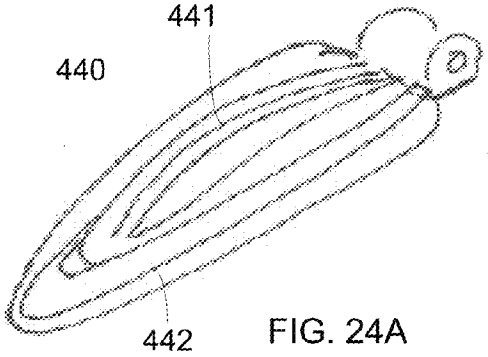
FIG. 24A
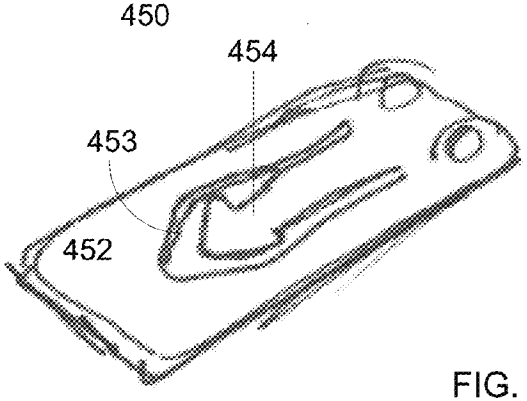
FIG. 25

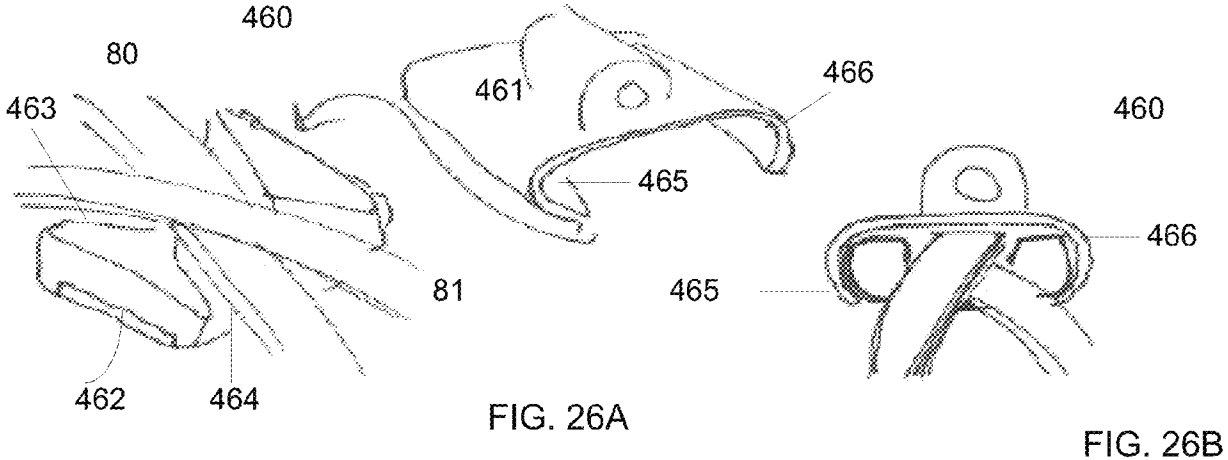
FIG. 26A
FIG. 26B
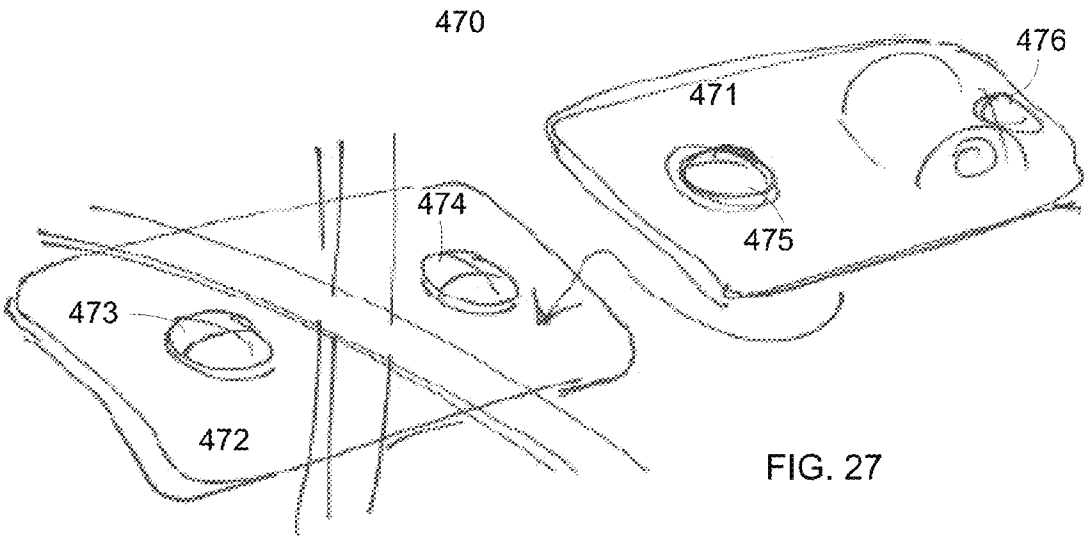
FIG. 27

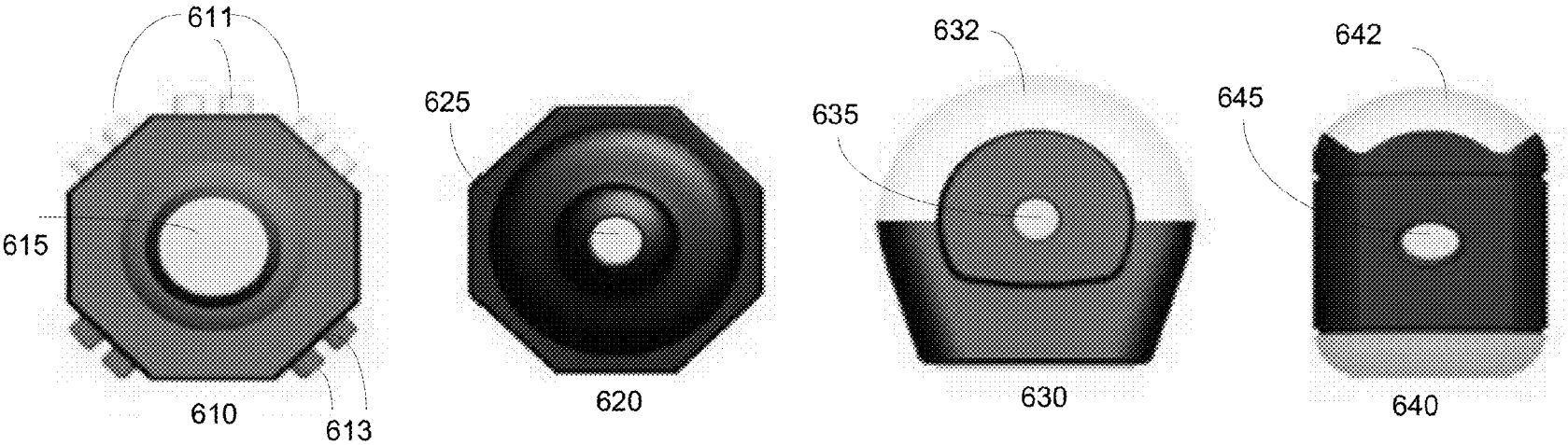
FIG. 34A
FIG. 35A
FIG. 36A
FIG. 37A
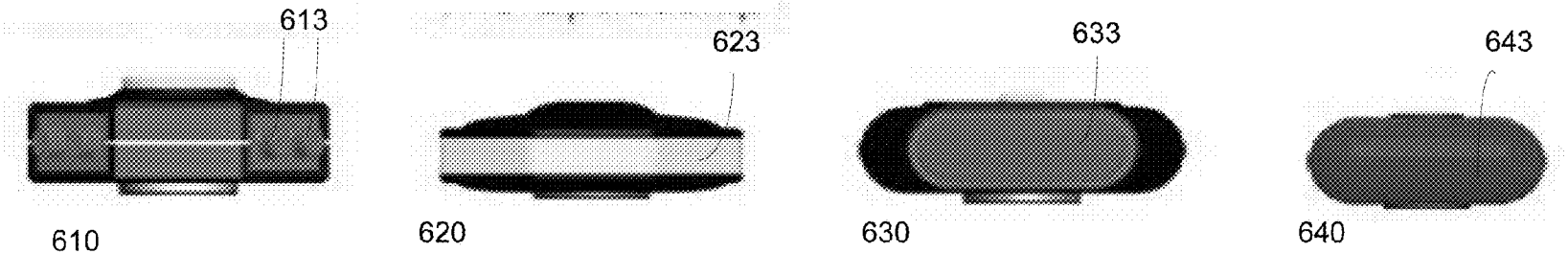
FIG. 34B
FIG. 35B
FIG. 36B
FIG. 37B 651a
651b
651c
651d
651e
651f
650
652a
652b
652c
652d
Backward Facing Red Lights
45 Degrees

656

656
651c
652a

652a

On / Off
Button
652a 650
651c

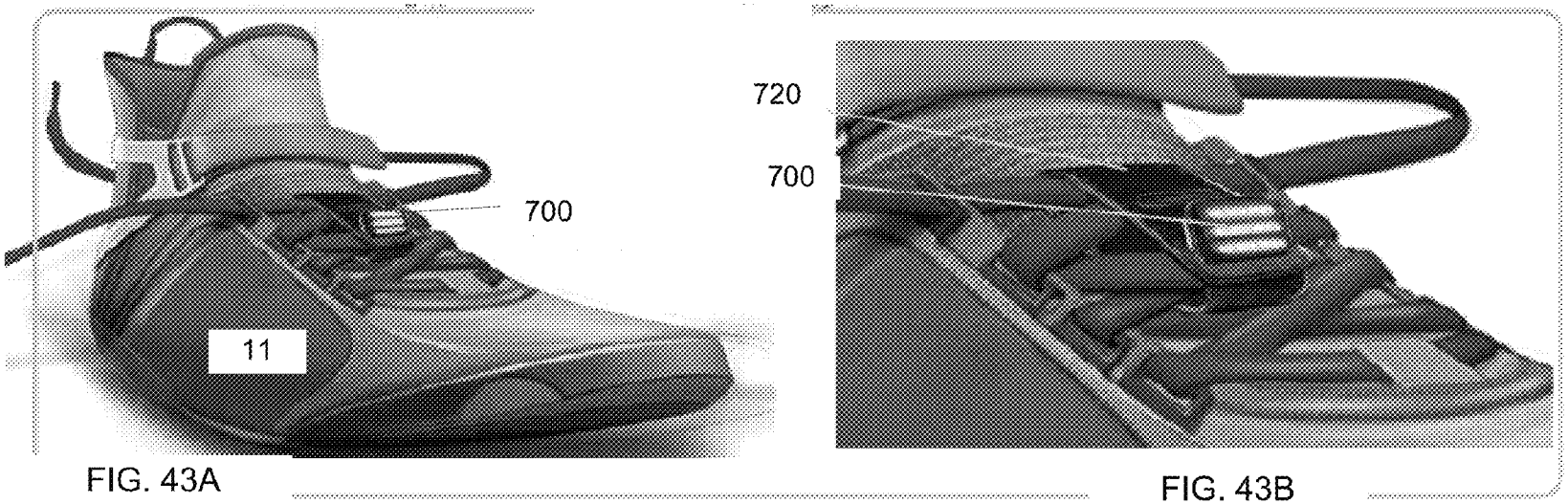
FIG. 43A
FIG. 43B
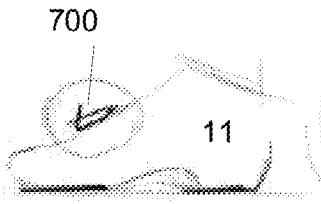
FIG. 43C
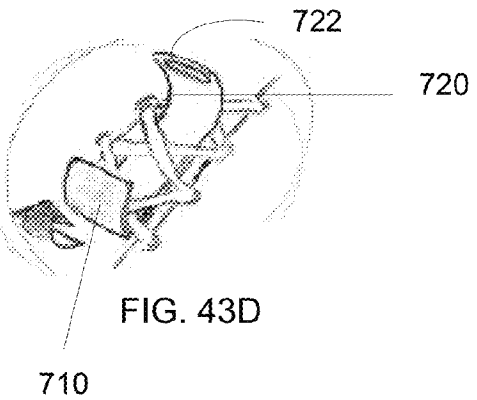
FIG. 43D

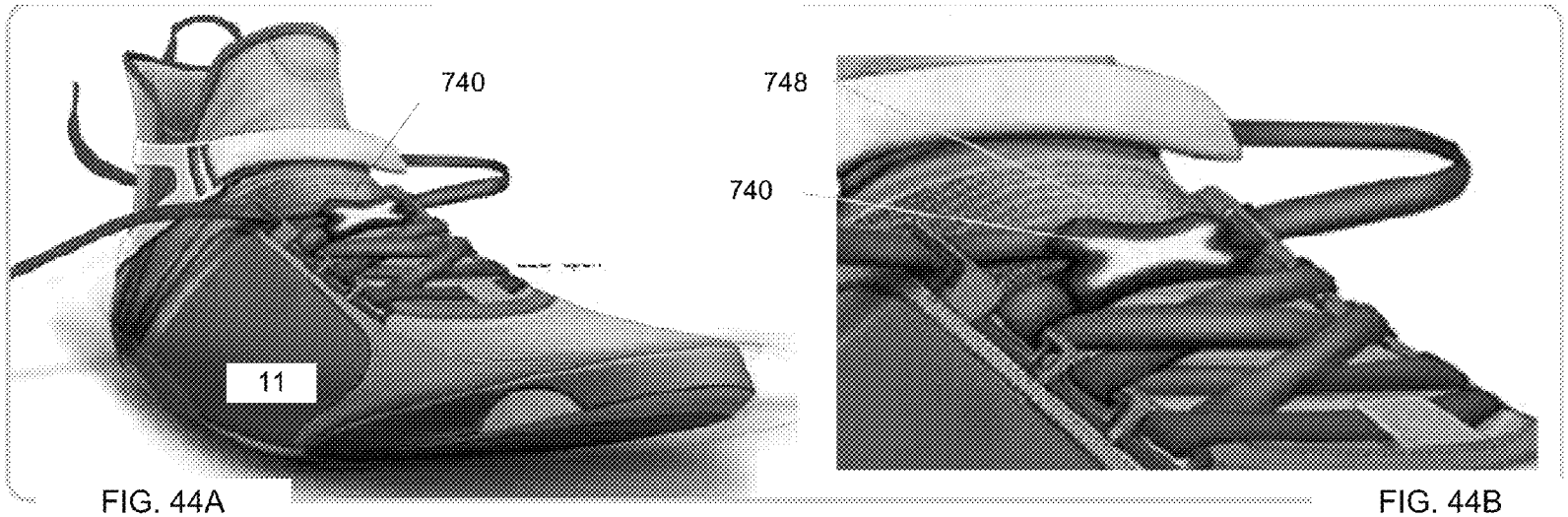
FIG. 44A
FIG. 44B
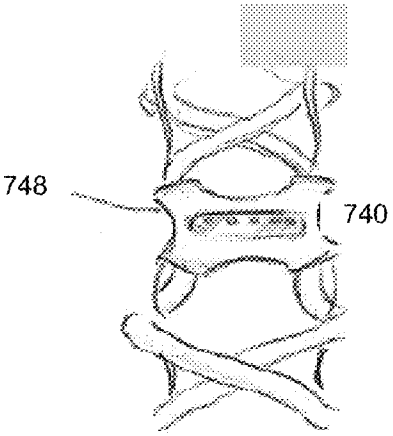
FIG. 44C

SHOE LIGHT DEVICE AND METHOD

RELATED APPLICATIONS

This application claims the benefit of U.S. Provisional Application No. 61/793,594, filed by applicant on Mar. 15, 2013, the contents of which are hereby incorporated by reference.

FIELD OF THE INVENTION

The present invention generally relates to portable lighting devices, and more particularly, to portable lighting devices attachable to shoes or footgear for lighting the path of a runner or walker.

BACKGROUND OF THE INVENTION—PRIOR ART

Night time running safety products are generally divided into two categories, those that provide visibility of the runner or walker, such as reflective clothing, vests and blinking lights, and those that assist the runner in seeing like headlamps and hand-held lights.

SUMMARY

Night Runner™ shoe lights safely lights the way for running and walking at night. In one embodiment, a pair of LED light units are powered by a rechargeable battery designed to keep runners and walkers safe and injury free. The light units attach to the shoelaces to provide advance warning of trip hazards and increase the runners and walkers visibility to traffic.

The units are small, light, and unobtrusive to the running and walking experience. The unique motion of the shoe lights during running or walking captures the attention of drivers. The shoe lights provide illumination of hazards and traffic.

DESCRIPTION OF FIGURES

These and other features, aspects, and advantages of the present invention will become better understood with regard to the following description, appended claims, and accompanying drawings where:

FIG. 12A is a side view of a spring clip slide lace attachment element.

FIG. 12B is a top perspective view of the spring clip slide of FIG. 12A attached to shoe laces.

FIG. 13A is a side view of a torque with clip lace attachment element attached to shoe laces.

FIG. 13B is a side view of the torque with clip of FIG. 13A.

FIG. 14A is a side view of a hinge and snap lace attachment element attached to shoe laces.

FIG. 14B is a side perspective view of the hinge and snap of FIG. 14A in an open orientation.

FIG. 15A is a top perspective view of a soft hook and loop strap lace attachment element attached to shoe laces.

FIG. 15B is a side perspective view of the soft hook and loop strap of FIG. 15A in an open orientation.

FIG. 18 is an exploded top perspective view of a magnet lock lace attachment element positioned relative to shoe laces.

FIG. 19A is a top perspective view of a twist lock screw lace attachment element which may be positioned relative to shoe laces.

FIG. 19B is an exploded top perspective view of the twist lock screw of FIG. 19A.

FIG. 24A is a top exploded perspective view of a hairclip lace attachment element.

FIG. 24B is a side view of the hairclip lace attachment element of FIG. 24A in an open orientation.

FIG. 24C is a side view of the hairclip lace attachment element of FIG. 24A in a closed orientation.

FIG. 25 is a top perspective view of a flex lock lace attachment element.

FIG. 26A is a top exploded perspective view of a cross lock lace attachment element.

FIG. 26B is a side view of the cross lock lace attachment element of FIG. 26A in a closed orientation.

FIG. 27 is a top exploded perspective view of a snap lock lace attachment element.

FIGS. 34A, 34B, 35A, 35B, 36A, 36B, 37A, and 37B are top and side views of various light housings.

FIG. 43A is an end perspective view of a light housing mounted on a shoe with a band.

FIG. 43B is an end perspective close-up view of the light housing of FIG. 43A.

FIG. 43C is a side view of the light housing of FIG. 43A.

FIG. 43D is a side perspective view of the light housing of FIG. 43 showing the band inserted under the shoe laces.

FIG. 44A is an end perspective view of a light housing mounted on a lace attachment element.

FIG. 44B is an end perspective close-up view of the light housing of FIG. 44A.

FIG. 44C is a top view of the light housing of FIG. 44A.

DESCRIPTION OF EMBODIMENT

In this embodiment, Night Runner™ Shoe Lights comprise self-contained light housing modules which include an array of LEDs for front illumination, a rechargeable power system, and a single control button. In this specification, the term "light source" means one or more LED, bulb, laser, Organic Light Emitting Diode (OLED), or other photon-generating element.

LED shoe lights fasten securely to one or both shoes with shoe lace attachment elements, and have multi-position adjustability through a pivotal connection between the lace attachment element and the light housing.

In one example, the light housing provides an encasement in a high impact plastic that is water resistant or waterproof.

In one example, the light housing is designed to be easily removable from the lace attachment element. In other examples, the lace attachment element has a first part that can stay attached to a shoe while a second part is detachable with the light housing. In other examples, the light housing and the lace attachment element are easily removable from the shoe. The light housing can then be used with other support brackets for other sports and activities such as cycling, skiing, skateboarding, etc.

In one example, the LED lights generate over fifty lumens (50+) in the smallest and lightest practical configuration.

In one example, the water resistant or waterproof switch has 5 modes: high, low, interval, blinking and off. In some examples, an indicator light is provided to alert when the battery needs to be recharged. In some examples, side and rear facing marker lights allow the runner and walker to be seen from the side and rear.

In one example, batteries are rechargeable and provide at least 10 hours of run time per charge. Battery recharging may be provided with a power transformer that plugs into an electrical outlet and provides power to a rechargeable battery through a USB port or other electrical connector. In this specification, the term "power source" means one or more battery, or other supply of electrical current. In some examples, power may be provided to the shoe lights through kinetic, motion charging, solar energy, electromagnetic harvesting or artificial photosynthesis. In this specification, the term "rechargeable power source" means a rechargeable battery, or direct supply of electrical current, such as provided by the kinetic energy of the runner or walker.

Example—Shoe Light

Figure 1:
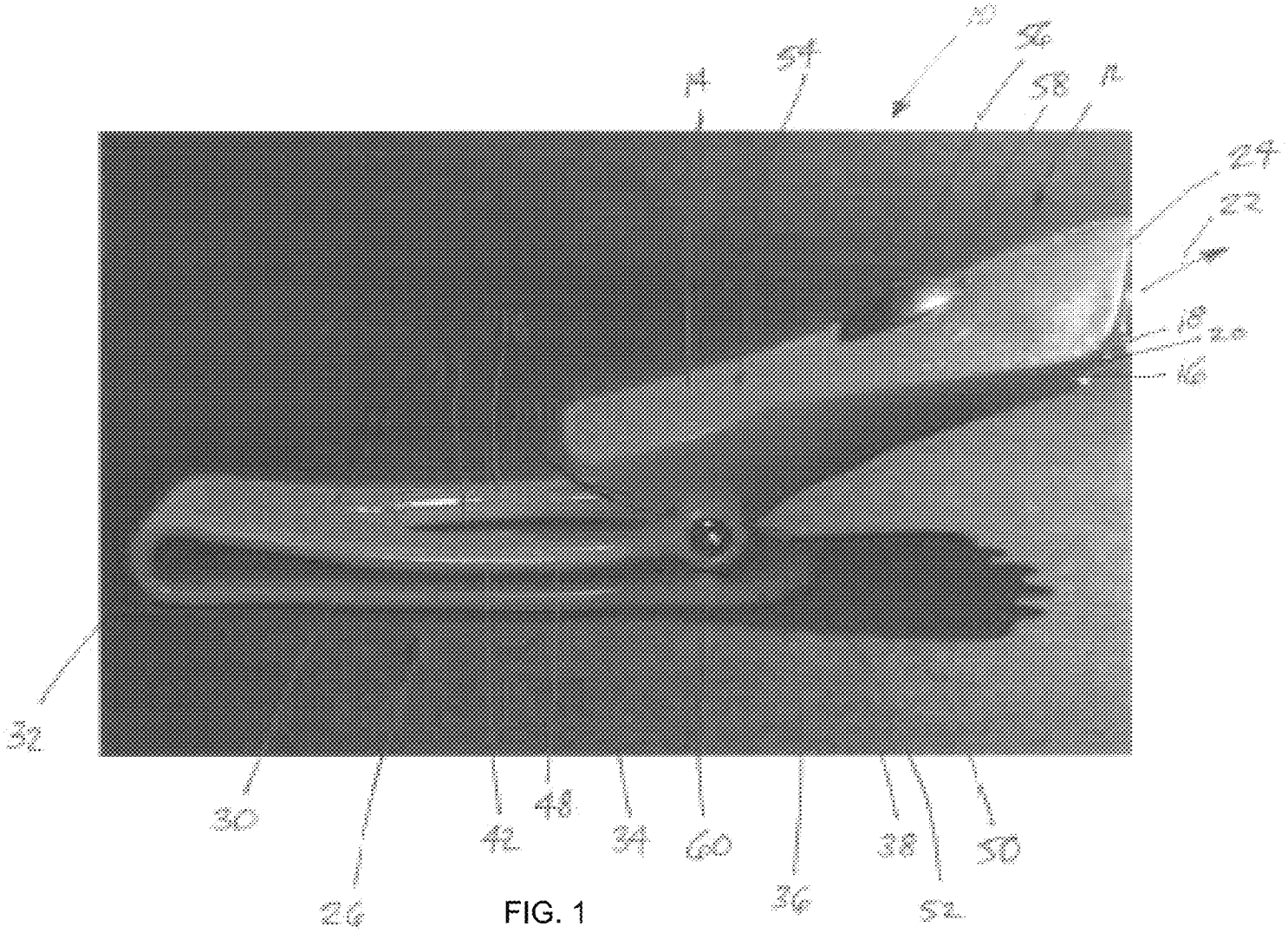
FIG. 1 is a perspective view of one embodiment of a shoe light.
Figure 2:
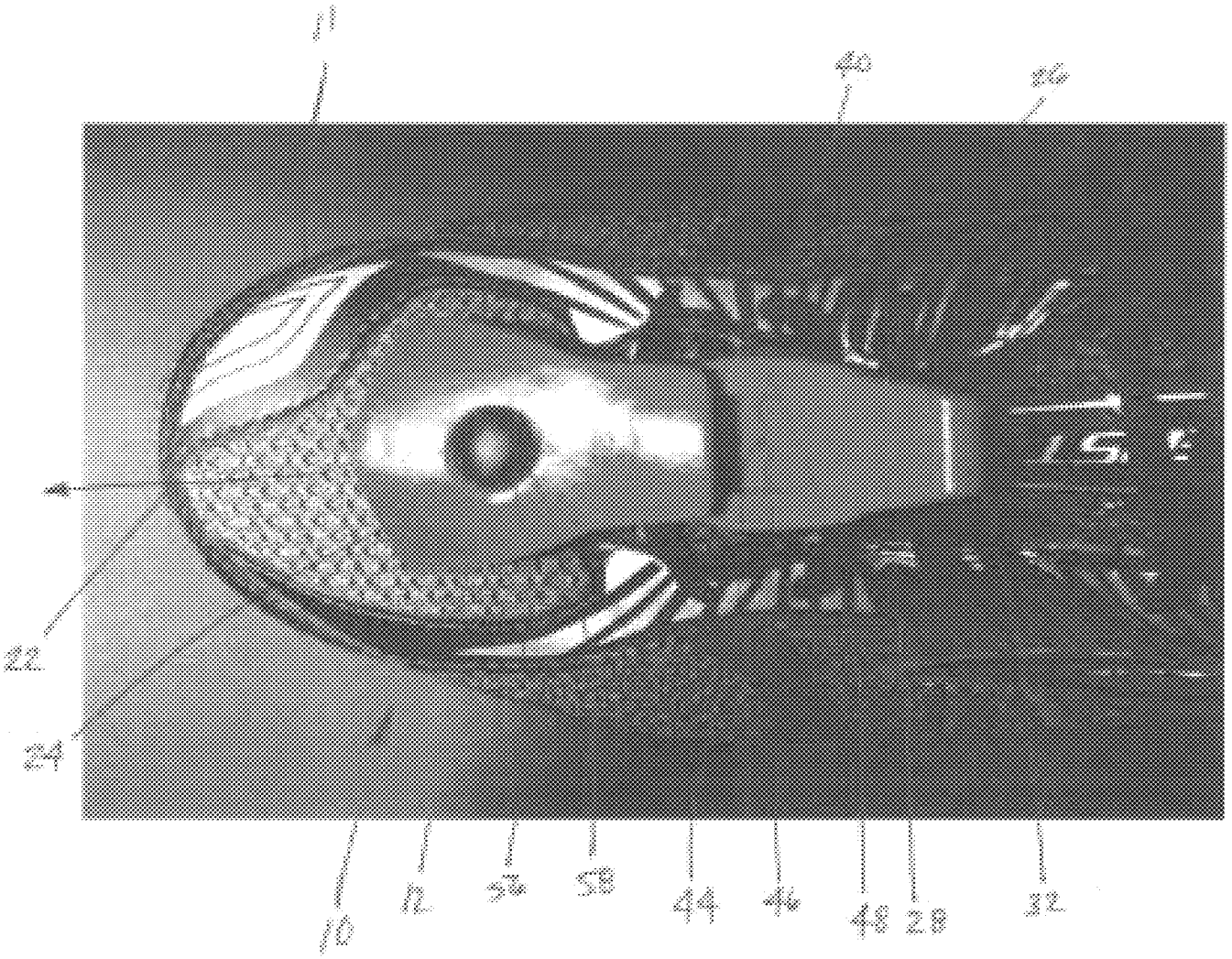
FIG. 2 is a top view of the shoe light of FIG. 1 shown attached to a shoe.
Figure 3:
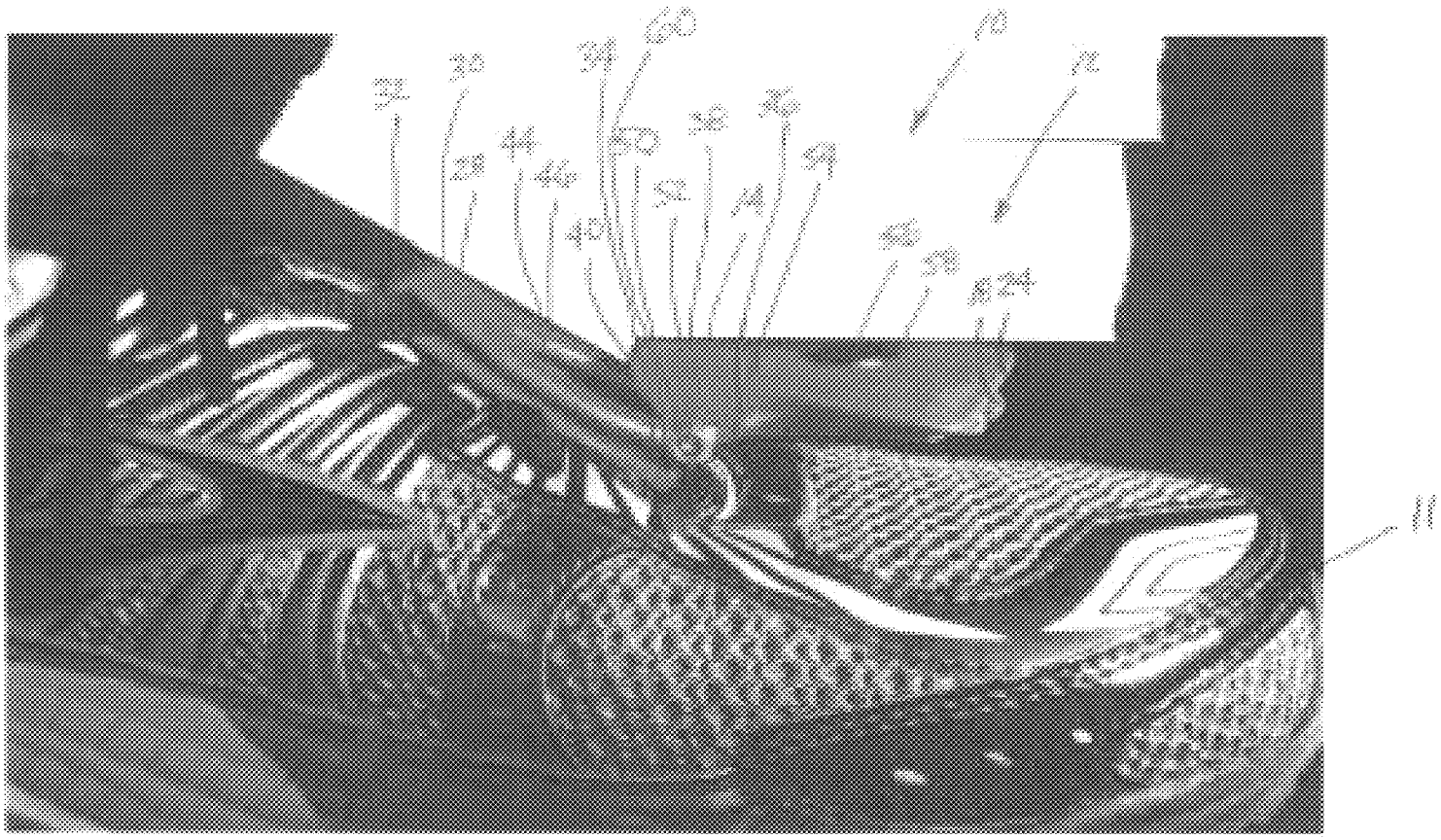
FIG. 3 is a perspective view of the shoe light of FIG. 1 shown attached to a shoe.

FIGS. 1-3 show an example shoe light 10 configured to be attachable to a shoe 11 of a walker or runner. The shoe light 10 may be configured to be releasably attached to a shoe 11 and may be adjusted relative to the shoe 11 such that as a user's foot strikes the ground, light is cast out in front of the shoe to illuminate the user's path. A user may attach a shoe light 10 to each shoe 11, thereby enabling the user's path to be lit at all times.

In this example, the shoe light comprises a lace attachment element, a light housing, and a pivotal connector between the lace attachment element and the light housing.

Light Housing

In this example, the shoe light 10 is formed from a light housing 12 forming an outer shell 14 with an internal cavity 16 housing at least one light source 18 extending through at least one orifice 20 in the light housing 12. The light source 18 is positioned to cast light in a first direction 22 from a first end 24 of the light housing 12. The first direction is toward the front of the shoe. The light source 18 is formed from one or more LEDs. The LEDs may be aligned with each other or may be offset to broaden the width thorough which light is cast.

The light housing 12 may include one or more power sources 54 within the internal cavity 16. The power source 54 may be rechargeable. The power source 54 may be a battery or other appropriate energy source. The light housing 12 may also include an on/off switch 56 exposed through an orifice 58 in the light housing 12, and in communication with the power source 54 and the light source 18. The switch may provide a plurality of lighting modes—such as bright, dim, blinking, interval or other patterns.

Lace Attachment Element

In this example, the lace attachment element is a releasable connector 26 formed from first and second arms 28, 30 coupled together at a first end 32 and separated by a gap 34 forming an opening 36 between the first and second arms 28, 30 at a second end 38. The second end 38 of the releasable connector 26 is attached to a second end 40 of the light housing 12. One or more retention teeth 60 may be positioned at the opening 36 to retain lace segments between the first and second arms 28, 30. The first and second arms 28, 30 may be biased towards each other. The first arm 28 of the releasable connector 26 may have a convex surface 42 facing the second arm 30 such that the convex surface 42 is positioned in closer proximity to the second are 30 than the first arm 28 relative to the second are 30 at the first end 32. The convex surface 42 may bind against the shoe laces. The first arm 38 of the releasable connector 26 may include an access orifice 44 positioned between first and second yoke arms 46, 48.

In this example, the shoe light 10 may be attached to a shoe by inserting laces into the opening 36 between the first and second arms 28, 30. The shoe laces will generally extend orthogonally relative to the first and second arms 28, 30. The opening 36 may be configured such that the opening faces the toe of a shoe 11 when attached to a shoe 11. As such, the light housing 12 and releasable connector 26 hang on the laces from the first end 32 of the releasable connector 26. The first end 32 of the releasable connector 26, where the first and second arms 28, 30 are coupled together, bares against the laces with each foot strike. Thus, the releasable connector 26 in constantly pushed into the correct position with each and every foot strike. As such, the shoe light 10 remains attached to a user's shoe 11 throughout a run.

Pivotal Connector

The releasable connector 26 is rotatably coupled to the light housing 12 with pivotal connector 52. The second end 38 of the releasable connector 26 on the first and second yoke arms 46, 48 of the first arm 28 each includes a pin housing 50 configured to receive a connector 52. The connector 52 may be any appropriate member, such as, but not limited to, a threaded screw, a pin and a post. The releasable connector 26 and the light housing 12 may be formed from any appropriate material, such as, but not limited to, metal, such as aluminum, carbon fiber, plastic and combinations thereof.

The shoe light 10 may be adjusted relative to the shoe 11 so that light is cast in the desired direction. More particularly, the light housing 12 may be rotated in an upward direction relative to the releasable connector 26 about the connector 52. The connector 52 is tightened sufficiently such that the light housing 12 may stay in positioned relative to the releasable connector 26 while running or walking, yet enable a user to adjust the angle of the light housing 12 relative to the releasable connector 26 by hand without tools.

Pivotal Attachments

In this specification, the terms "pivotal attachment", "pivotal connection", and "pivotal connector" mean a joint or other attachment mechanism between a lace attachment element and a light housing, or between a lace attachment element and a light housing support platform.

FIGS. 4-11 show several types of pivotal attachments that may be used with a shoe light.

Example—Ball Joint

Figure 4A:
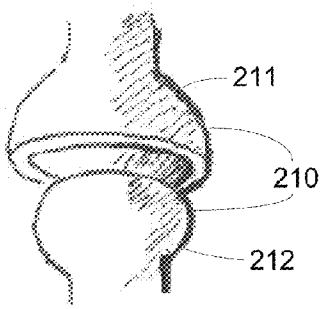
FIG. 4A is a side perspective view of a ball joint.
Figure 4B:
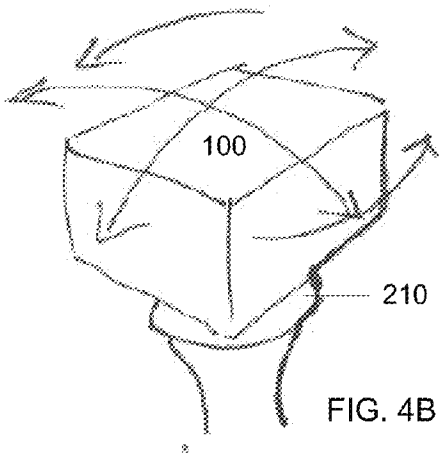
FIGS. 4B and 4C are side perspective views of a light housing mounted on the ball joint of FIG. 4A.
Figure 4C:
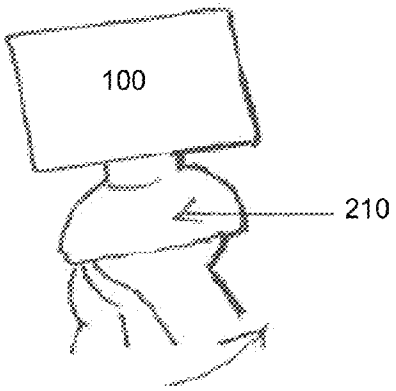

FIG. 4A is a side perspective view of a ball joint 210 comprising a socket 211 and a ball 212. FIGS. 4B and 4C are side perspective views of a light housing 100 mounted on the ball joint 210 of FIG. 4A. In this example, the light housing is mounted on the socket portion of the ball joint. In other examples, the light housing is mounted on the ball portion of the ball joint.

Example—Magnet Joint

Figure 5A:
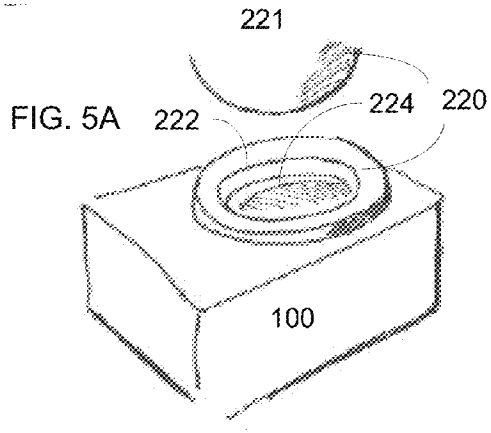
FIG. 5A is a side perspective view of a magnet joint.
Figure 5B:
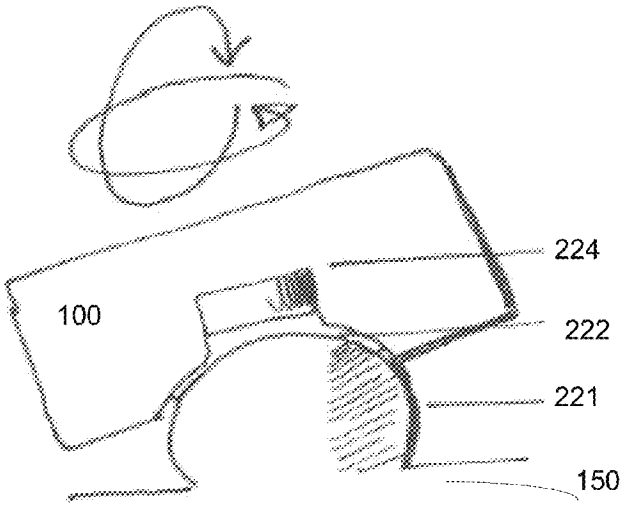
FIG. 5B is side perspective view of a light housing mounted on the magnet joint of FIG. 5A.

FIG. 5A is a side perspective view of a magnet joint 220 comprising a magnet 224 recessed in a socket 222, and a steel ball 221. FIG. 5B is side perspective view of a light housing 100 mounted on the magnet joint 220 of FIG. 5A. In this example, the socket is lined with rubber to provide a high friction against the steel ball.

Example—Standard Hinge

Figure 6B:
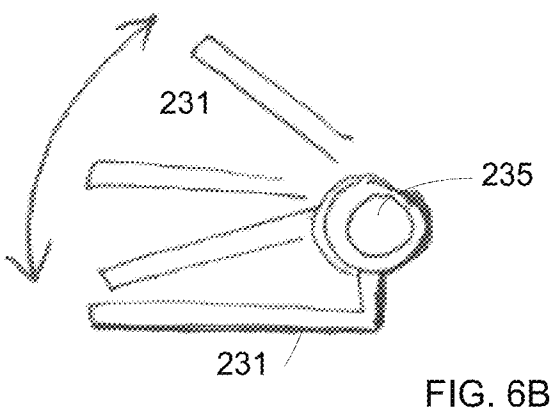
FIG. 6B is side view of the hinge of FIG. 6A.
Figure 6A:
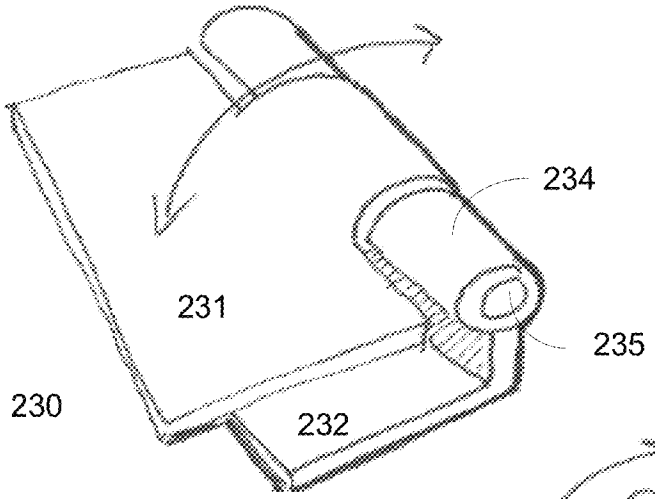
FIG. 6A is a top perspective view of a hinge.
Figure 6C:
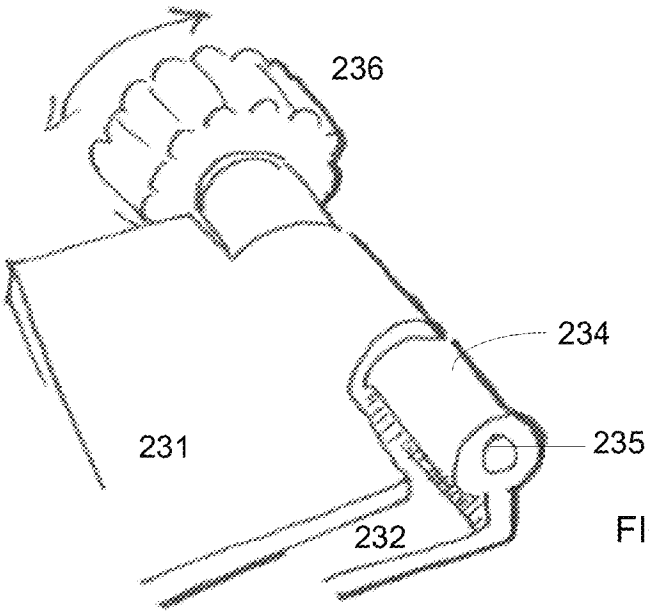
FIG. 6C is a top perspective view of a hinge with a locking knob.

FIG. 6A is a top perspective view of a hinge 230 between a top element 231 and a bottom element 232. The hinge includes a pin 235 and a pin housing 234. FIG. 6B is side view of the hinge of FIG. 6A. FIG. 6C is a top perspective view of a hinge with a locking knob 236 that holds the top element 231 in a desired orientation with respect to the bottom element.

Example—Spring Hinge

Figure 7B:
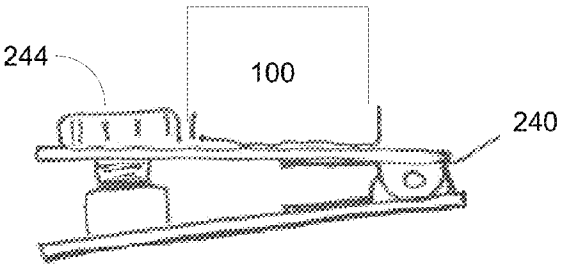
FIG. 7B is a side view of the spring hinge of FIG. 7A.
Figure 7A:
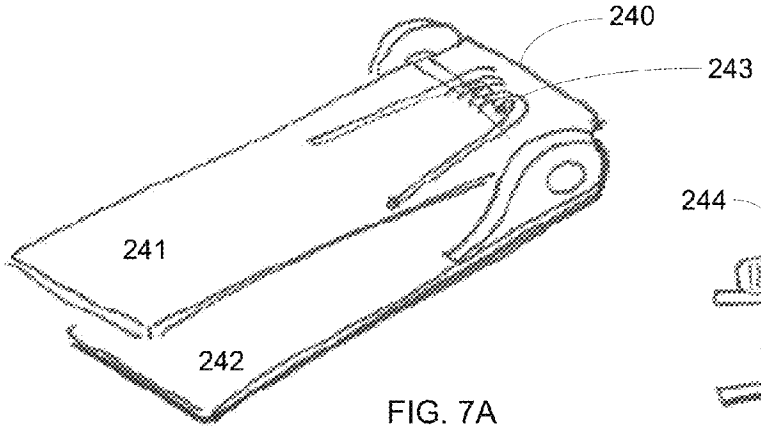
FIG. 7A is a top perspective view of a spring hinge.

FIG. 7A is a top perspective view of a spring hinge 240 between a top element 241 and a bottom element 242. The spring hinge includes a spring 243 to force the top element toward the bottom element. FIG. 7B is side view of the spring hinge of FIG. 7A where the top element supports a light housing 100, and an adjustment element 244 is used to set the desired orientation of the top element and light housing with respect to the bottom element. In this example, the bottom element is part of a lace attachment element.

Example—Interlocking Hinge

Figure 8:
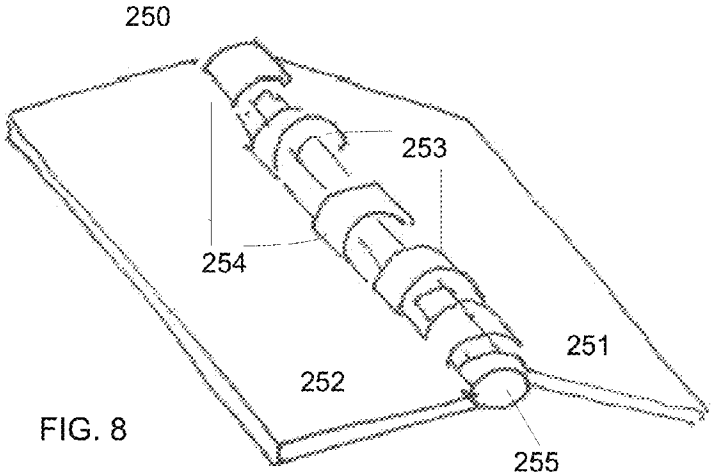
FIG. 8 is top perspective view of an interlocking hinge.

FIG. 8 is top perspective view of an interlocking hinge 250 between a top element 251 and a bottom element 252. The hinge includes a pin 255 that is segmented so that portions of the pin are attached to both the top and bottom elements. The top element includes pin engagement elements 254, and the bottom element includes pin engagement elements 253, so that the top and bottom elements can snap together along the segmented pin.

Example—Pivot Knob

Figure 9B:
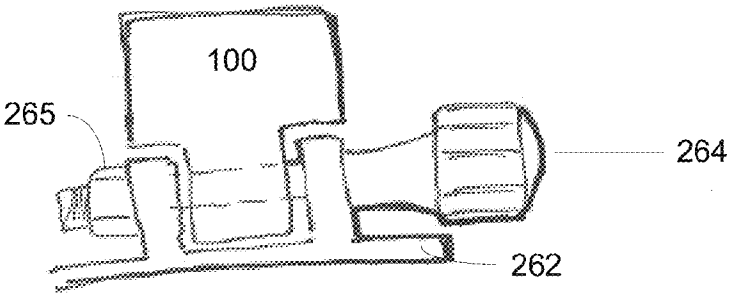
FIG. 9B is a side view of the pivot knob of FIG. 9A.
Figure 9A:
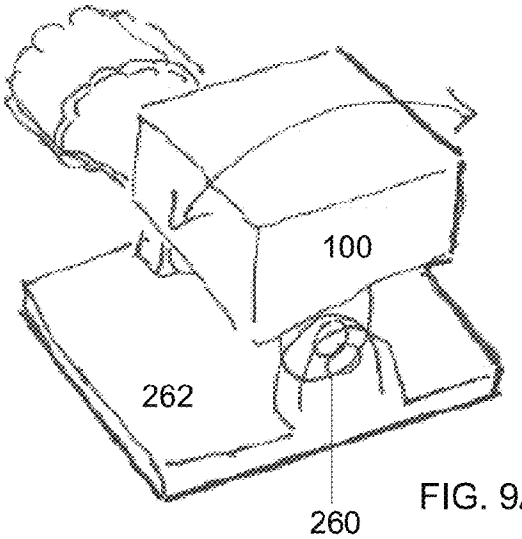
FIG. 9A is a top perspective view of a pivot knob.

FIG. 9A is a top perspective view of a pivot knob 260 between a light housing 100 and a bottom element 262 which is part of a lace attachment element. FIG. 9B is a side view of the pivot knob of FIG. 9A showing a locking screw 264 and nut 265 to hold the light housing in a desired orientation.

Example—Clip Lock Hinge

Figure 10B:
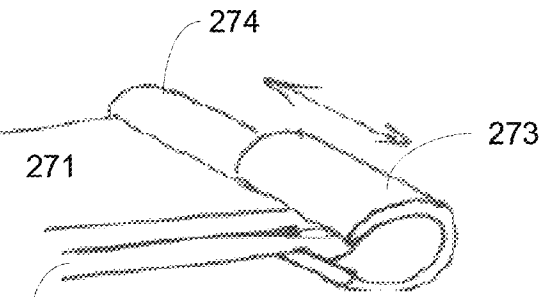
FIG. 10B is a detailed view of clip lock being inserted on the clip lock hinge of FIG. 10A.
Figure 10A:
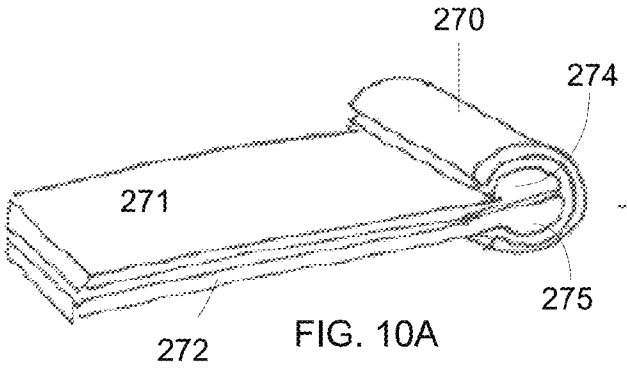
FIG. 10A is a side perspective view of a clip lock hinge.

FIG. 10A is a side perspective view of a clip lock hinge 270 between a top element 271 and a bottom element 272. The top and bottom elements include extensions 274 and 275 which are held together with a slide-on clip lock 273. FIG. 10B is a detailed view of clip lock 273 being inserted on the clip lock hinge of FIG. 10A.

Example—Metal Pivot Track

Figure 11B:
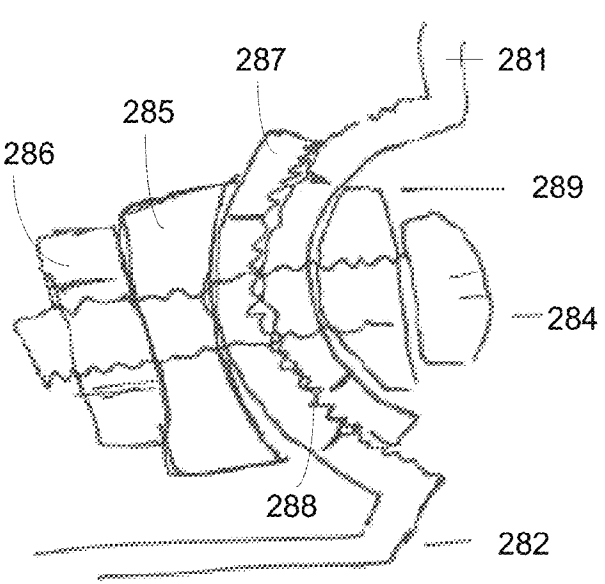
FIG. 11B is a side perspective view of the metal pivot track of FIG. 11A.
Figure 11A:
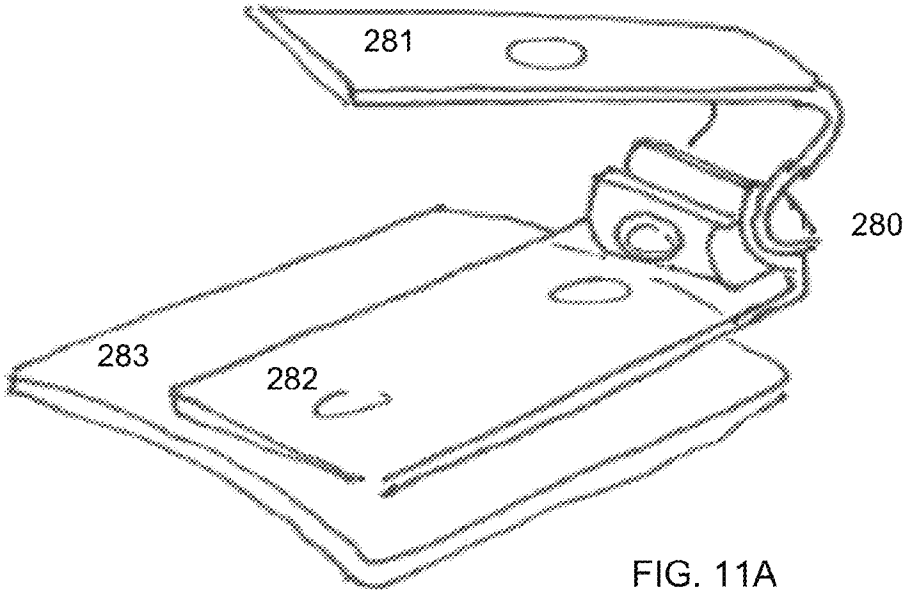
FIG. 11A is a side perspective view of a metal pivot track.

FIG. 11A is a side perspective view of a metal pivot track 280 with a top top element 281 and a bottom element 282 attached to a lace attachment element 283. FIG. 11B is a side perspective view of the metal pivot track of FIG. 11A showing teeth 287 and 288 on the pivot surfaces of the top top element 281 and a bottom element 282, a lock bolt 284, nut 286, and washers 285 and 289.

Shoe Lace Attachment Elements

In this specification, the term "lace attachment element" means a single element or combination of elements configured to be held in place on a shoe with respect to laces, strap(s), cord, hooks, or other closures on the shoe.

FIGS. 12-32 show several types of lace attachment elements that may be used with a shoe light.

Example—Spring Clip Slide

FIG. 12A is a side view of a spring clip slide 310 lace attachment element showing a clip slide 312 which slides into housing 311. FIG. 12B is a top perspective view of the spring clip slide of FIG. 12A attached to shoe lace segments 80 and 81 so that the laces are held between the clip slide and the housing. A light housing may be pivotally attached to the clip, such as with pivot holder 315.

Example—Torque with Clip

FIG. 13A is a side view of a torque with clip 320 lace attachment element attached to shoe lace segments 80 and 81. The clip includes a top portion 321 and a bottom portion 322. FIG. 13B is a side view of the torque with clip of FIG. 13A. In this example the light housing may be attached to or integral to the top element.

Example—Hinge and Snap

FIG. 14A is a side view of a hinge and snap 330 lace attachment element attached to shoe lace segments 80,81,82, and 83. The hinge and snap includes a snap feature 334 on lower portion 332 which is inserted into a slot 335 on upper portion 331 to lock the device over the shoe lace segments. FIG. 14B is a side perspective view of the hinge and snap of FIG. 14A in an open orientation.

Example—Soft Hook and Loop Strap

FIG. 15A is a top perspective view of a soft hook and loop strap 340 lace attachment element attached to shoe laces. In this example, a hook and loop fastener is used to secure a top portion 341 to a bottom portion 342, and to secure the device on shoe lace segments 80 and 81. Either or both of the top and bottom portions may be soft, such as a heavy fabric. FIG. 15B is a side perspective view of the soft hook and loop strap of FIG. 15A in an open orientation. A light housing may be pivotally attached to the soft hook and loop strap, such as with pivot holder 345.

Example—Fixed Mounting Plate

Figure 16:
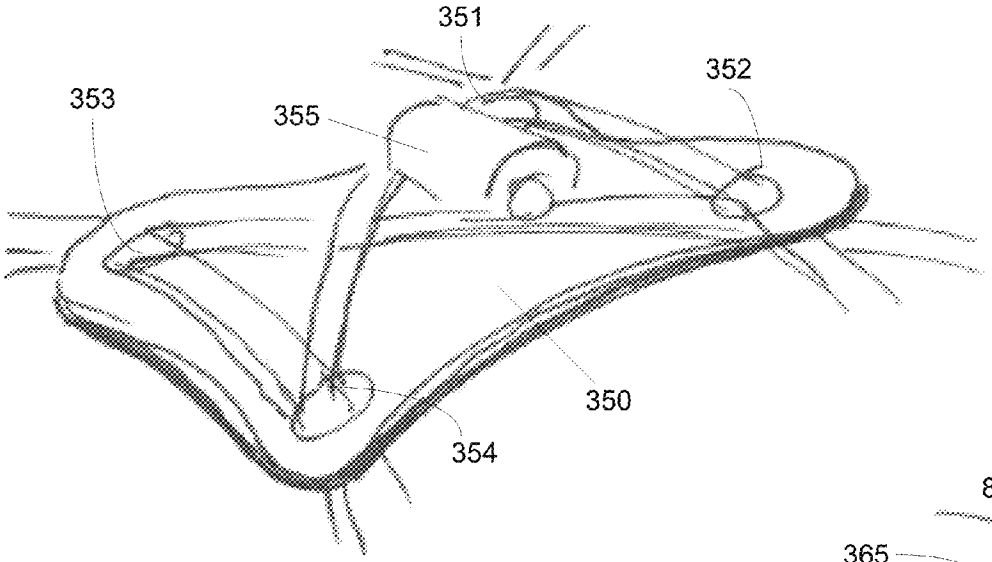
FIG. 16 is a top perspective view of a fixed mounting plate lace attachment element attached to shoe laces.

FIG. 16 is a top perspective view of a fixed mounting plate 350 lace attachment element attached to shoe laces by threading the lace segments through holes 351, 352, 353, and 354. A light housing may be pivotally attached to the plate, such as with pivot holder 355. The plate may be rigid or soft, such as a fabric, leather, or soft polymer.

Example—Rubber Friction

Figure 17:
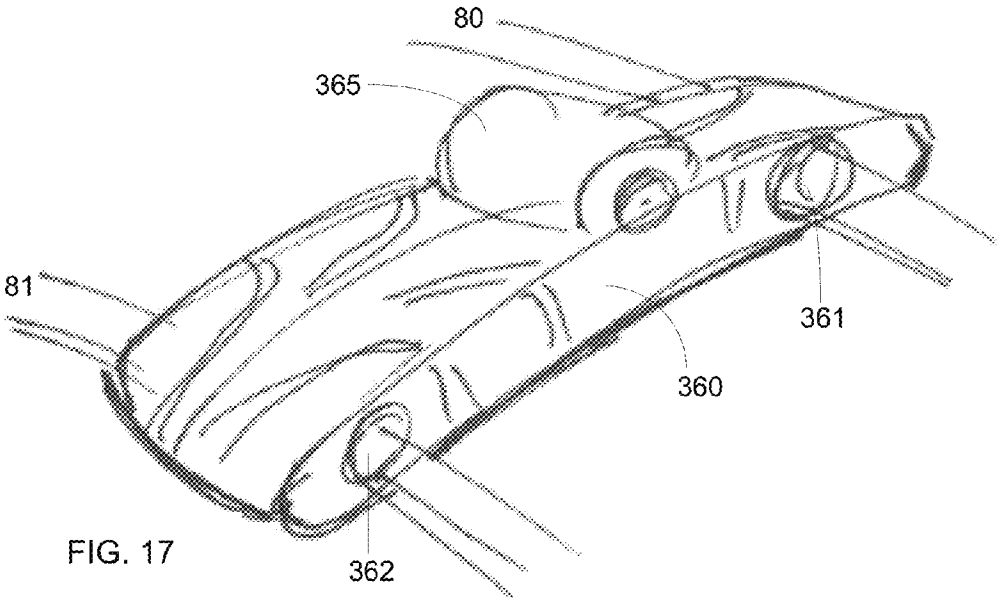
FIG. 17 is a top perspective view of a rubber friction plate lace attachment element attached to shoe laces.

FIG. 17 is a top perspective view of a rubber friction plate 360 lace attachment element attached to shoe lace segments 80 and 81. The lace segments are threaded through channels 361 and 362. The plate may have a bottom surface with a high friction coefficient to resist sliding relative to the tongue of the shoe. A light housing may be pivotally attached to the plate, such as with pivot holder 365.

Example—Magnet Lock

FIG. 18A is an exploded top perspective view of a magnet lock 370 lace attachment element positioned relative to shoe laces with bottom portion 372 positioned under lace segments 80 and 81. In this example, bottom portion 372 includes a plurality of strong magnets 374 which engage top portion 371 to hold the top portion in place. The bottom portion may be rigid or compliant. A light housing may be pivotally attached to the plate, such as with pivot holder 375.

Example—Twist Lock Screw

FIG. 19A is a top perspective view of a twist lock screw 380 lace attachment element which may be positioned relative to shoe laces. FIG. 19B is an exploded top perspective view of the twist lock screw lace attachment element of FIG. 19A showing a screw 383 to attach the top portion 381 to the bottom portion 382.

Example—Spring Lock

Figure 20B:
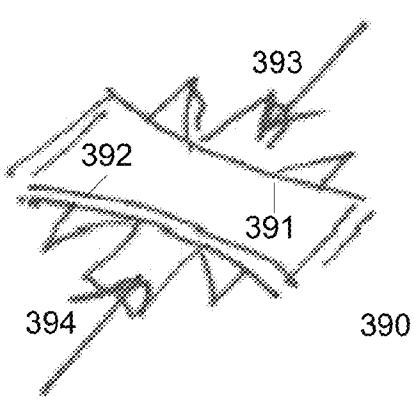
FIG. 20B is a top perspective view of the spring lock of FIG. 20A in a closed orientation.
Figure 20A:
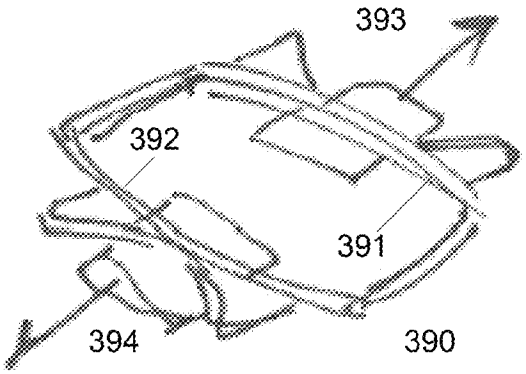
FIG. 20A is a top perspective view of a spring lock lace attachment element in an open orientation.

FIG. 20A is a top perspective view of a spring lock 390 lace attachment element in an open orientation with arms 391 and 392 spaced apart and locking members 393 and 394 space apart. The device may be placed over shoe lace segments and then closed. FIG. 20B is a top perspective view of the spring lock of FIG. 20A in a closed orientation so that locking members 393 and 394 are engaged and holding arms 391 and 392 closer together.

Example—Criss Cross

Figure 21:
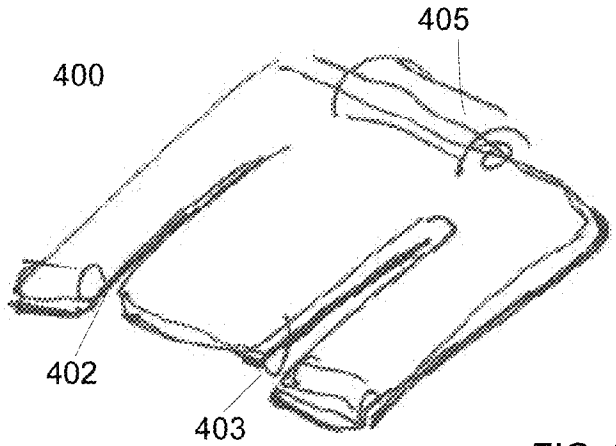
FIG. 21 is a top perspective view of a criss cross lace attachment element.

FIG. 21 is a top perspective view of a criss cross 400 lace attachment element. Soft or rigid plate includes slots 402 and 403. Lace segments are directed through the slots to hold the plate in place on the shoe. A light housing may be pivotally attached to the plate, such as with pivot holder 405.

Example—Slide Lock

Figure 22B:
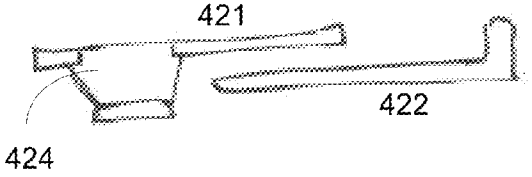
FIG. 22B is a side exploded view of the slide lock of FIG. 22A.
Figure 22A:
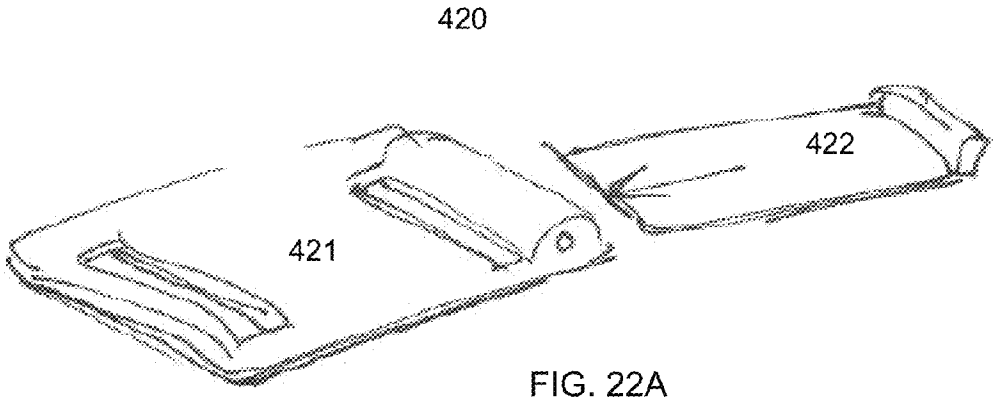
FIG. 22A is a top exploded perspective view of a slide lock lace attachment element.

FIG. 22A is a top exploded perspective view of a slide lock 420 lace attachment element where bottom portion 422 slides into top portion 421 to hold lace segments between the bottom portion and the top portion. FIG. 22B is a side exploded view of the slide lock of FIG. 22A showing a slide receptacle 424 on the upper portion.

Example—Top Slide Lock

Figure 23:
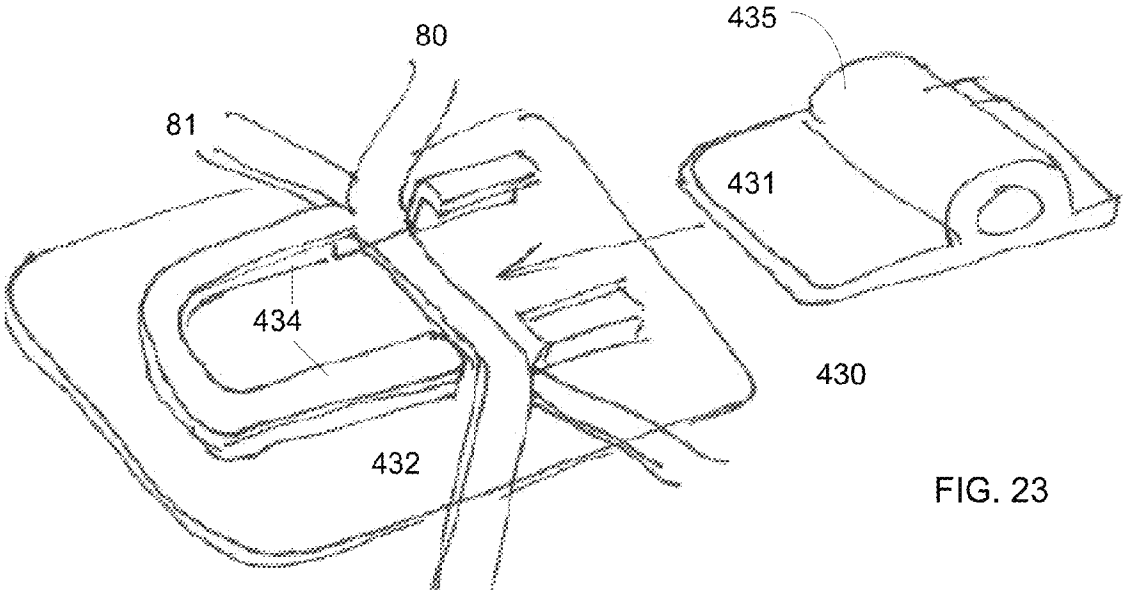
FIG. 23 is a top exploded perspective view of a top slide lock.

FIG. 23 is a top exploded perspective view of a top slide lock 430 lace attachment element where a top portion 431 slides into bottom portion 432 to hold lace segments 80 and 81 between the bottom portion and the top portion. A light housing may be pivotally attached to the plate, such as with pivot holder 435. The bottom portion may have integral rails 434 to accept the top portion, or rails may be provided on a compliant lower panel.

Example—Hairclip

FIG. 24A is a top exploded perspective view of a hairclip 440 lace attachment element with a top portion 441 and a bottom portion 442. FIG. 24B is a side view of the hairclip lace attachment element of FIG. 24A in an open orientation with a space between top portion 441 and bottom portion 442. FIG. 24C is a side view of the hairclip lace attachment element of FIG. 24A in a closed orientation where the top portion is compressed against bottom portion to hold the device in place over lace segments (not shown).

Example—Flex Lock

FIG. 25 is a top perspective view of a flex lock 450 lace attachment element with a base plate 452, a slot 453, and a retention element 454. In one example, the base plate is inserted below lace segments which are retained in slot 453 with retention element 454.

Example—Cross Lock

FIG. 26A is a top exploded perspective view of a cross lock 460 lace attachment element with a top portion 461 and a bottom portion 462 with lace inset features 463 and 464 to contain lace segments 80 and 81. The top portion includes wrap-around end sections 465 and 466 that slide on or snap to the bottom portion to hold the top in place. FIG. 26B is a side view of the cross lock lace attachment element of FIG. 26A in a closed orientation with the wrap-around end sections 465 and 466 engaging the bottom portion 462.

Example—Snap Lock

FIG. 27 is a top exploded perspective view of a snap lock 470 lace attachment element with a top portion 471 and bottom portion 472. In this example, the bottom portion includes projections 473 and 474 which snap into holes 475 and 476 on the top portion. In other examples, two or more projections may be provided in the top portion.

Example—Living Hinge Lock

Figure 28:
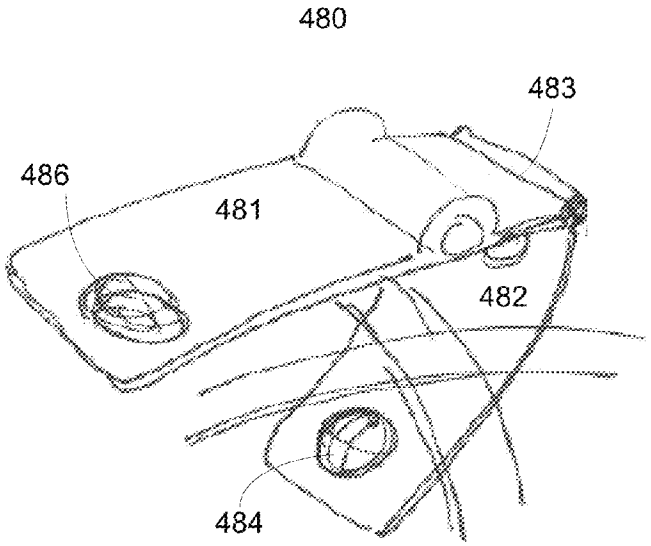
FIG. 28 is a top perspective view of a living hinge lock lace attachment element.

FIG. 28 is a top perspective view of a living hinge lock 480 lace attachment element with a living hinge 483 between a top portion 481 and a bottom portion 482. The bottom portion includes a snap projection 484 to mate with a hole 486 in the top portion.

Example—Press Lock

Figure 29B:
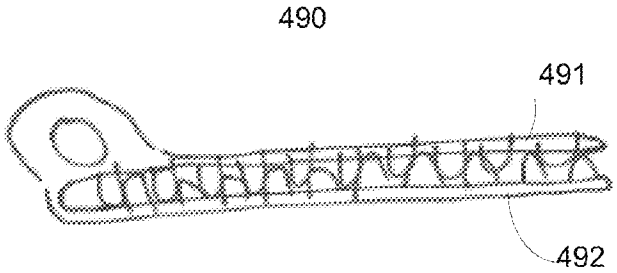
FIG. 29B is a side view of a press lock lace attachment element of FIG. 29A in a locked orientation.
Figure 29A:
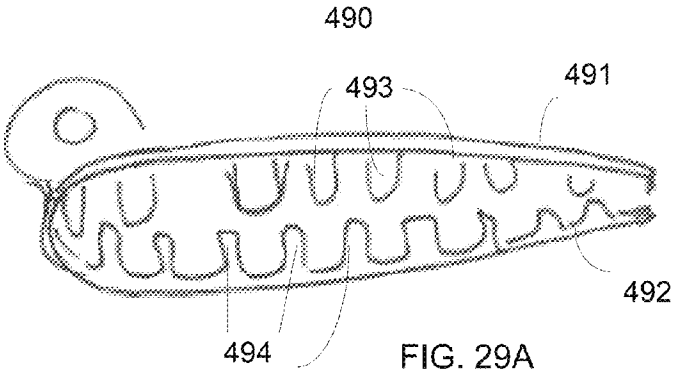
FIG. 29A is a side view of a press lock lace attachment element in an unlocked orientation.

FIG. 29A is a side view of a press lock 490 lace attachment element in an unlocked orientation. In this example, a plurality of projections 493 on the top portion 491, nest with a plurality of projections 494 on the bottom portion 492 to secure the top portion to the bottom portion as shown in FIG. 29B, which shows the device in a locked orientation.

Example—Cam Lock

Figure 30A:
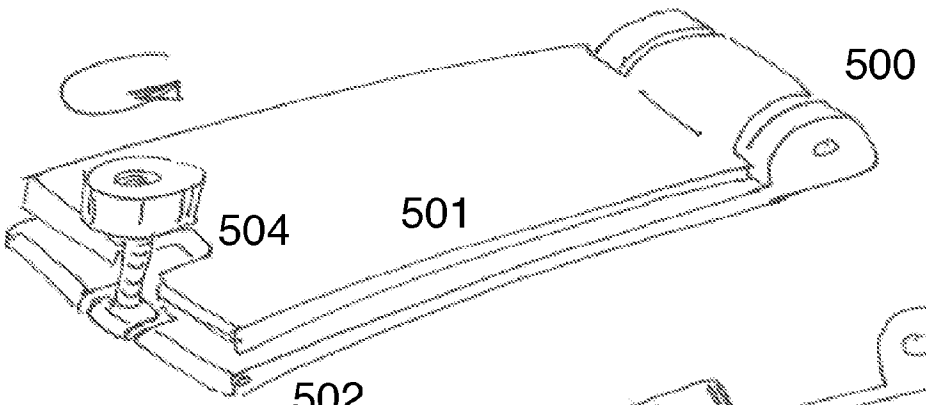
FIG. 30A is a top perspective view of a cam lock lace attachment element.
Figure 30B:
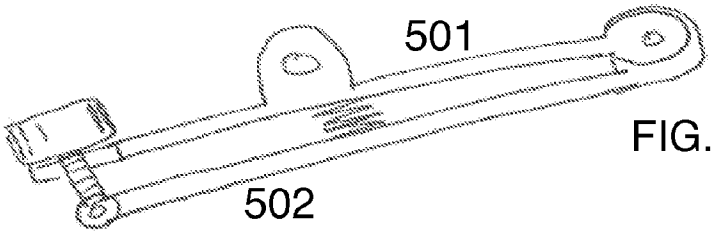
FIG. 30B is a top perspective view of the cam lock lace attachment element of FIG. 30A in a locked orientation.

FIG. 30A is a top perspective view of a cam lock 500 lace attachment element where top portion 501 is secured to bottom portion 502 with a cam 503 which engages a slot 504 on the top portion. FIG. 30B is a top perspective view of the cam lock lace attachment element of FIG. 30A held in a locked orientation with cam 503.

Example—Twist Lock

Figure 31:
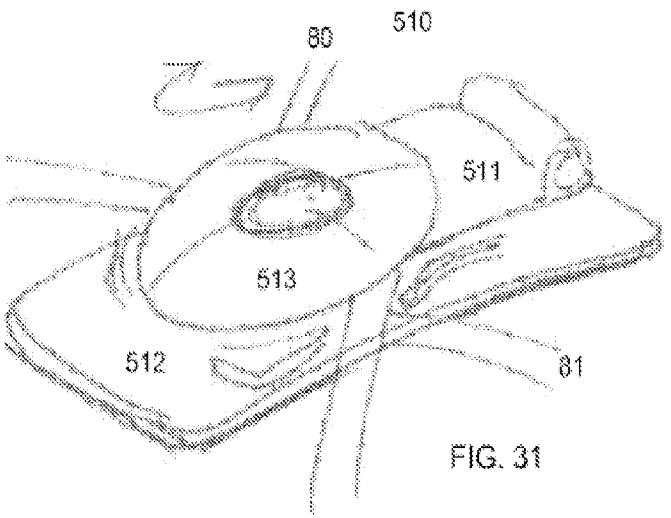
FIG. 31 is a top perspective view of a twist lock lace attachment element.
Figure 33B:
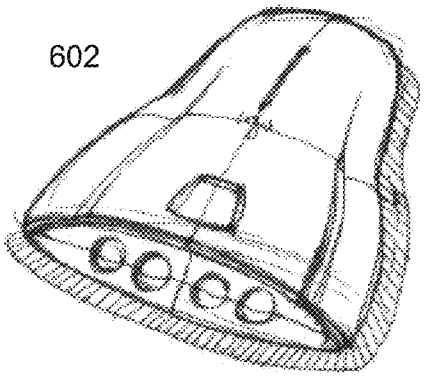
FIG. 33A-33E are top perspective views of various light housings.
Figure 33A:
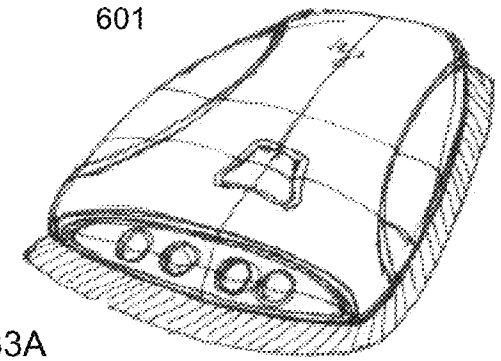
Figure 33D:
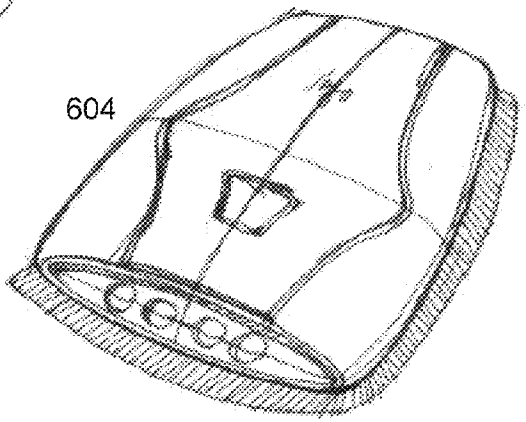
Figure 33C:
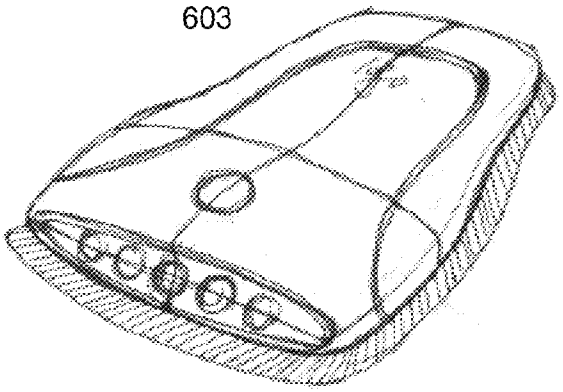
Figure 33E:
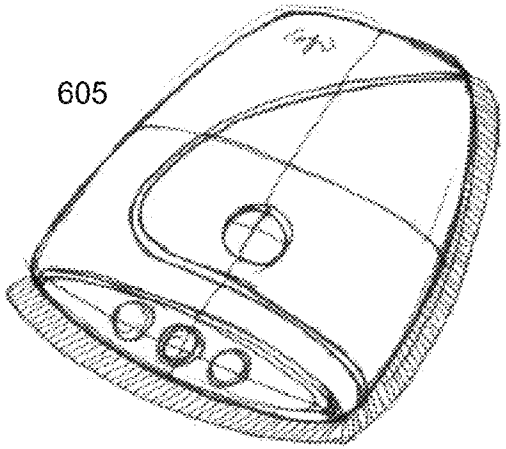
Figures 38A, 38B, 38C, 38D, 38E, 38F:
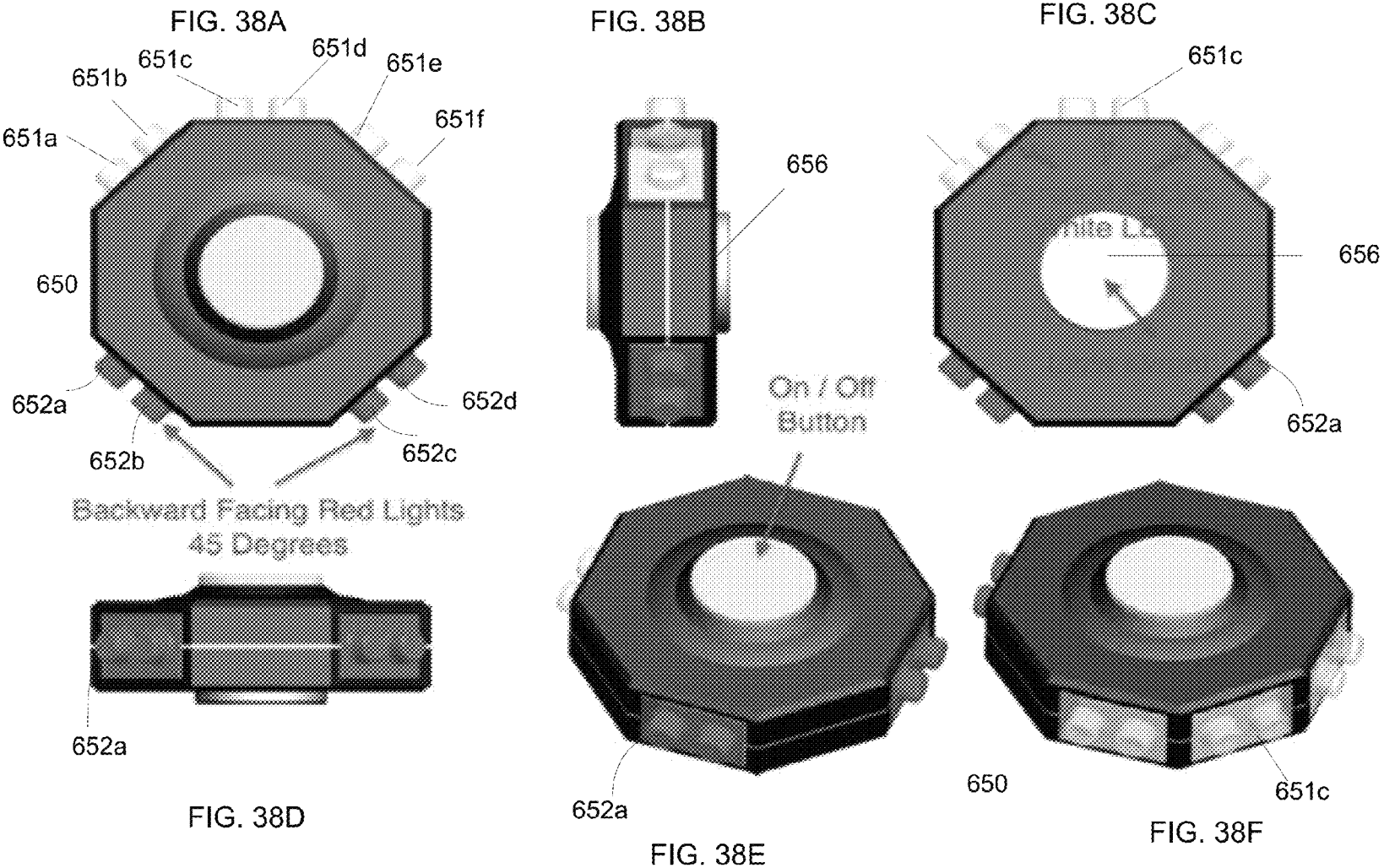
FIGS. 38A-38F are top, side, front, and rear views of a light housing.
Figure 39A:
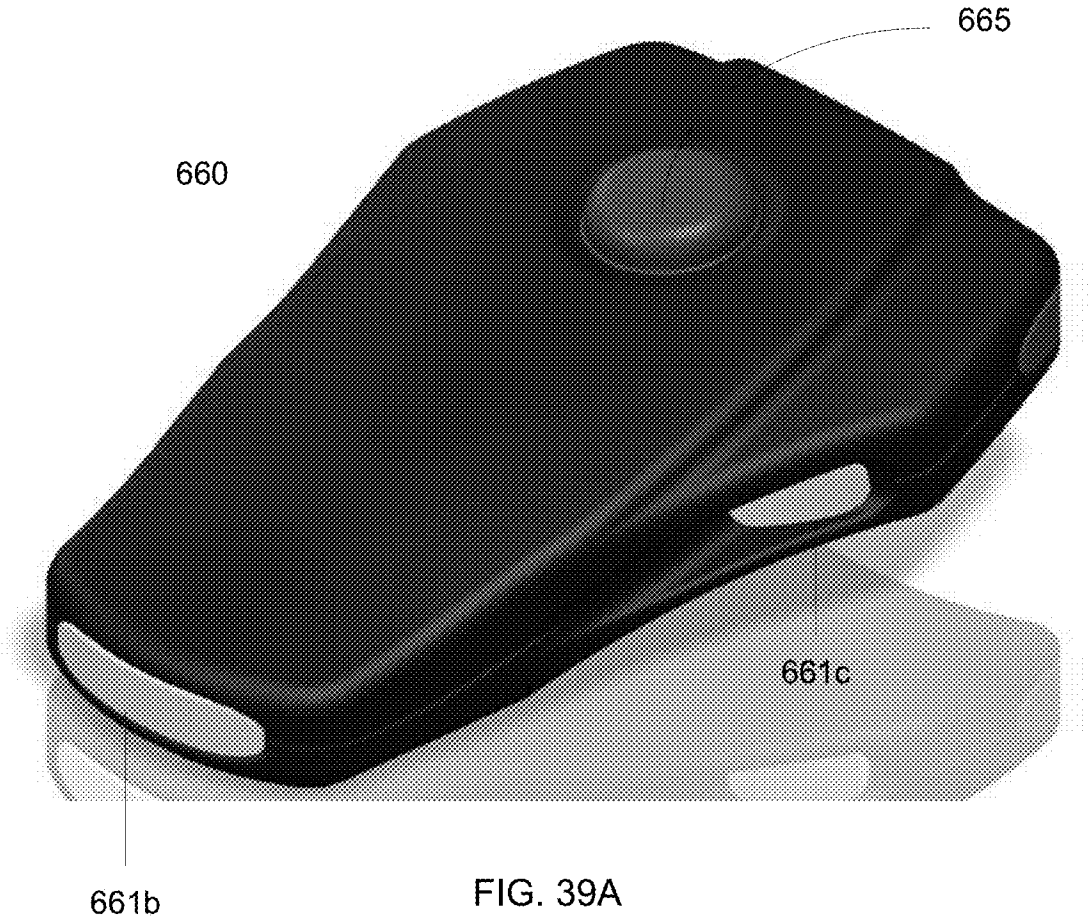
FIGS. 39A-39E are top and side views of a light housing.
Figure 39C:
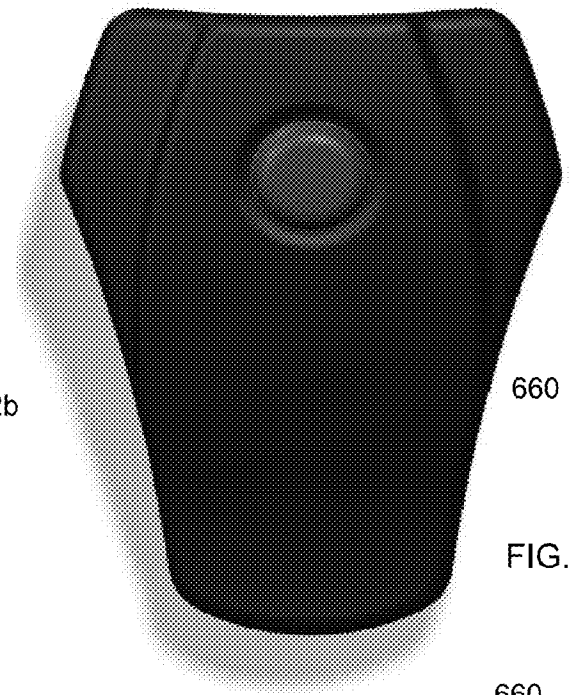
Figure 39B:
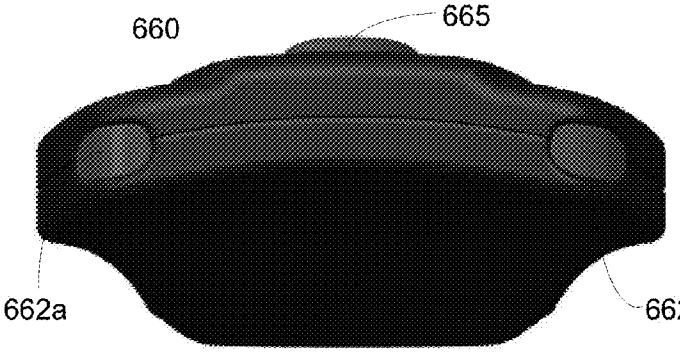
Figure 39E:
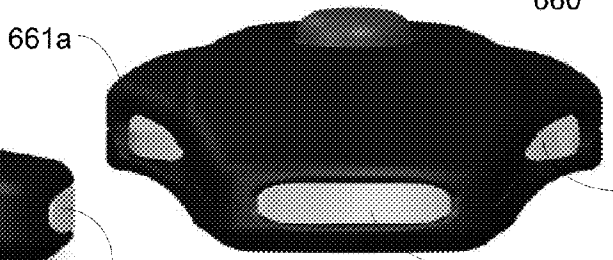
Figure 39D:
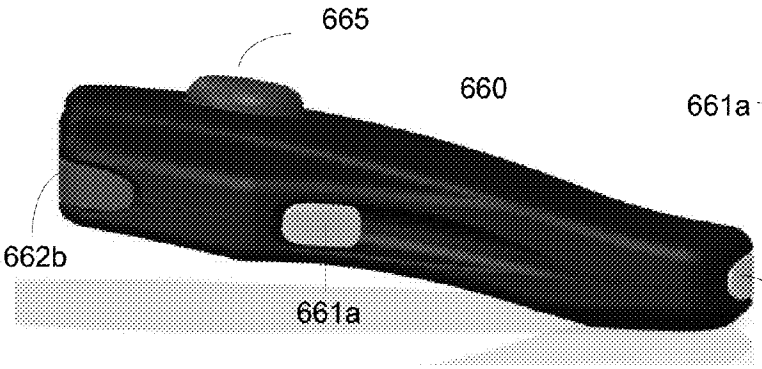

FIG. 31 is a top perspective view of a twist lock 510 lace attachment element where the top portion 511 is secured to the bottom portion 512 with a twist lock 513, and lace segments 80 and 81 are held between the top portion and the bottom portion.

Example—Track Lock

Figure 32:
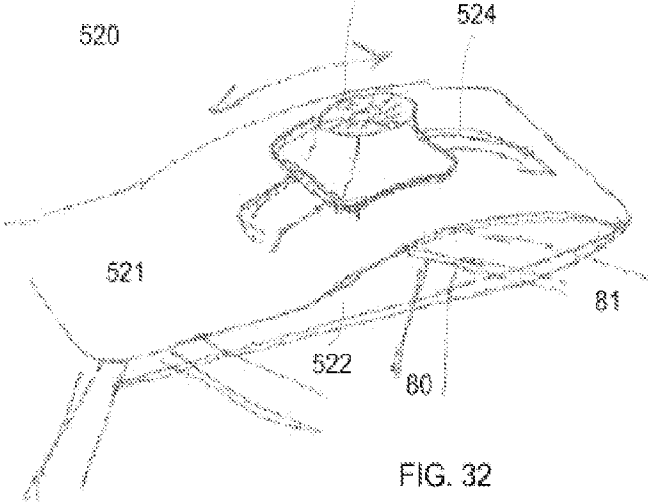
FIG. 32 is a top perspective view of a track lock lace attachment element.

FIG. 32 is a top perspective view of a track lock 520 lace attachment element where the top portion 521 is secured to the bottom portion 522 with a lock 523 movable along a slot 524, and lace segments 80 and 81 are held between the top portion and the bottom portion.

Light Housing Examples

FIG. 33A-33E are top perspective views of various light housings 601, 602, 603, 604, and 605. These examples have various shapes and three to five LEDs.

FIGS. 34-37 are top and side views of various light housings 610, 620, 630, and 640. These examples include forward-facing LEDs 611, with and without forward lens covers 622 (not labeled), 632, 642; rear-facing LEDs 613, with and without lens covers 623,633, and 643. The examples shown each have single on/off and control button 615, 625, 635, and 645.

FIGS. 38A-38F are top and side views of a light housing 650 with control button 655. In this example, there are six forward-facing LEDs where LEDs 651*a* and 651*b* are directed at a first forward angle; LEDs 651*c* and 651*d* face forward; and LEDs 651*e* and 651*f* are directed at a second forward angle. There are four rear-facing LEDs where LEDs 652*a* and 652*b* are directed at a first rear-facing angle; and LEDs 652*c* and 652*d* are directed at a second rear-facing angle. In this example, a magnet 656 is provided on the light housing in order to removably attach the light housing to a lace attachment element. The example has a single on/off and control button 655.

FIGS. 39A-39E are top and side views of a light housing 660 with two rear-facing recessed LEDs and rear lens covers 662*a* and 662*b*. In this example, there are three forward-facing lens covers with cover 661*a* directed at a first forward angle; cover 661*b* facing forward; and cover 661*c* directed at a second forward angle. The example has a single on/off and control button 665.

Figure 40:
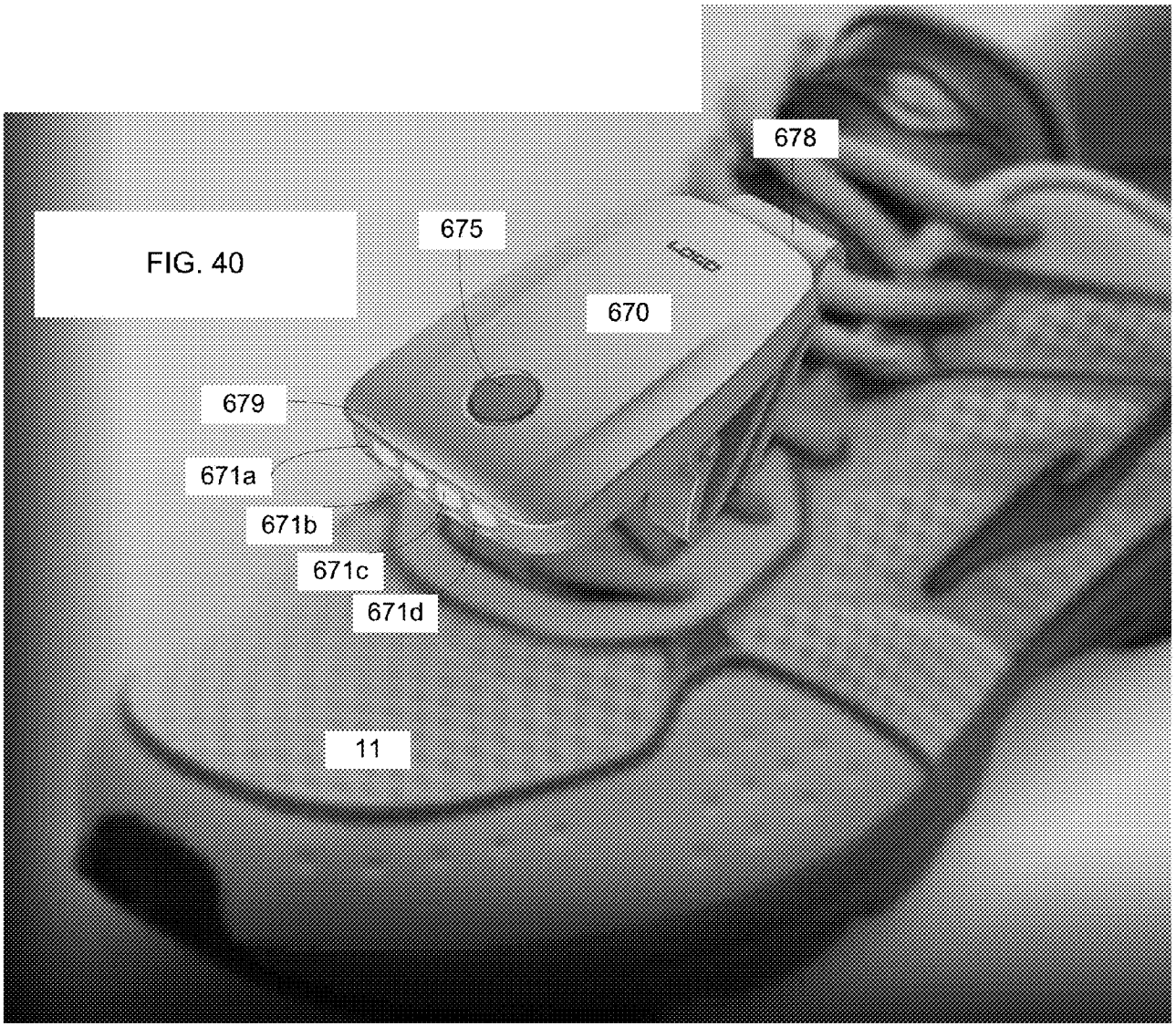
FIG. 40 is top perspective view of a light housing mounted on a shoe.

FIG. 40 is top perspective view of a light housing 670 mounted on a shoe 11 with lace attachment element 678. In this example, the light housing has four recessed forward-facing LEDs 671*a*, 671*b*, 671*c*, and 671*d*. The housing includes a lip overhang 679 which serves to shield the LEDs from a runner's eyes. The example has a single on/off and control button 675.

Figure 41:
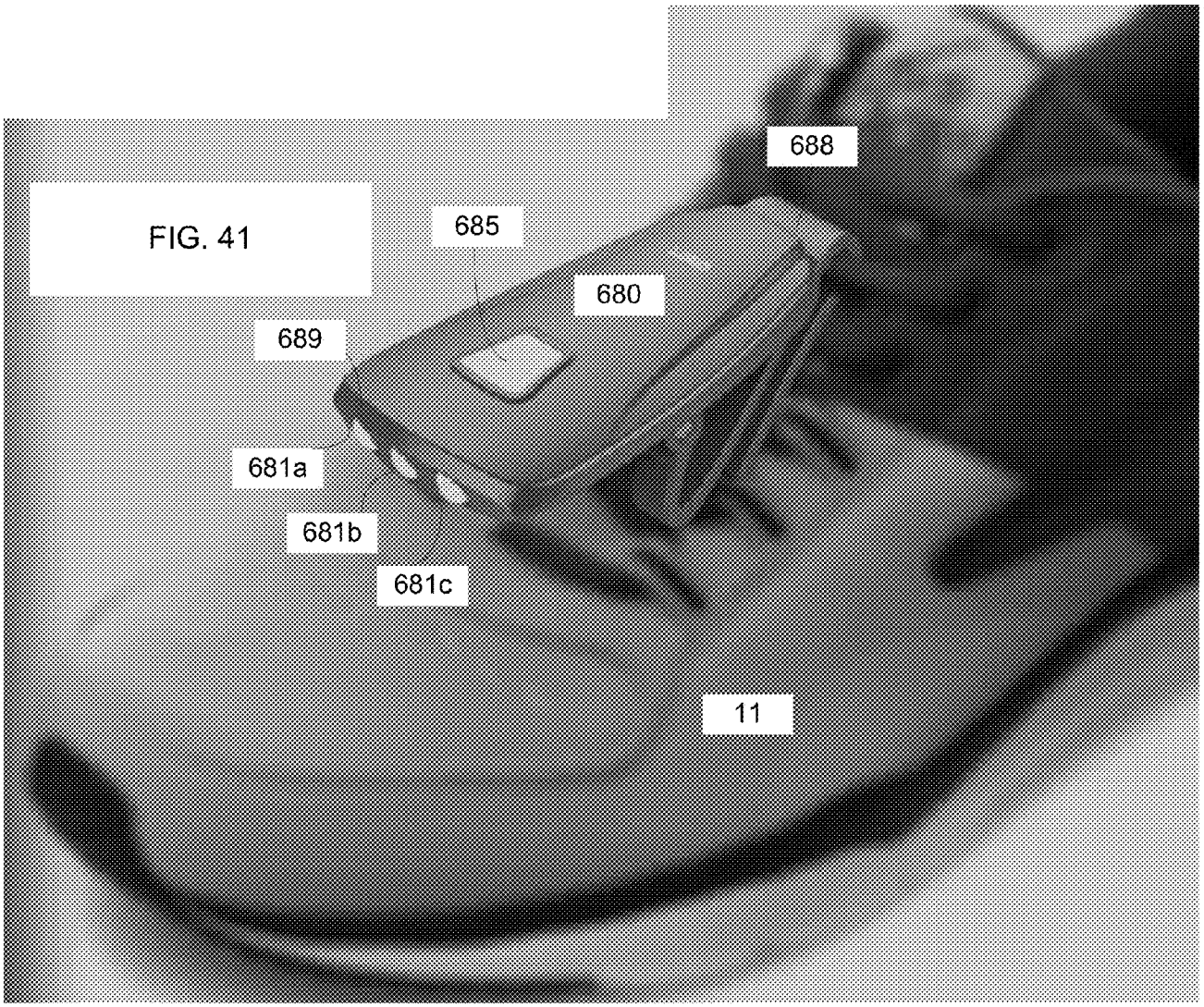
FIG. 41 is top perspective view of a light housing mounted on a shoe.

FIG. 41 is top perspective view of a light housing 680 mounted on a shoe 11 with lace attachment element 678. In this example, the light housing has three recessed forward-facing LEDs 681*a*, 681*b*, and 681*c*. The housing includes a lip overhang 689 which serves to shield the LEDs from a runner's eyes. The example has a single on/off and control button 685.

Figure 42:
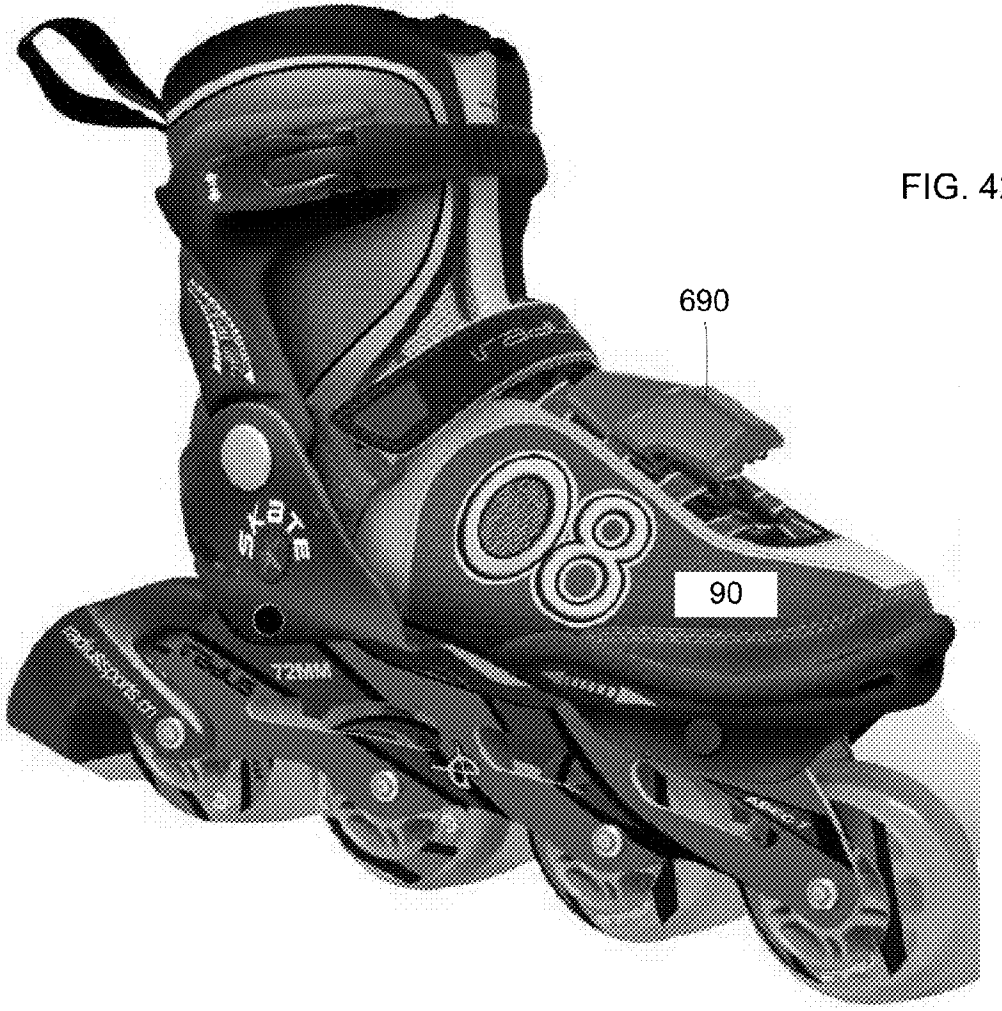
FIG. 42 is a side perspective view of a light housing mounted on an in-line skate.

FIG. 42 is side perspective view of a light housing 690 mounted on an in-line skate 90.

FIG. 43A is an end perspective view of a light housing 700 mounted on a shoe 11 with a band 720. In this example, the light housing is a thin panel 710 with a plurality of LEDs 701 which may be mounted on a flexible circuit board. FIG. 43B is an end perspective close-up view of the light housing 700 of FIG. 43A. FIG. 43C is a side view of the light housing 700 of FIG. 43. FIG. 43D is a side perspective view of the light housing of FIG. 43 showing the band inserted under the shoe laces. In this example, the light housing is designed to be inserted into a slot 722 on the band, so that the light panel is maintained at a desired angle with respect to the shoe. In other examples, a hook and loop fastener, or other closure element can be used to secure the light housing to the band.

FIG. 44A is an end perspective view of a light housing 740 mounted on a lace attachment element 748. FIG. 44B is an end perspective close-up view of the light housing 740 of FIG. 44A. FIG. 43C is a top view of the light housing 740 of FIG. 44A.

Figures 45A, 45B, 45C, 45D:
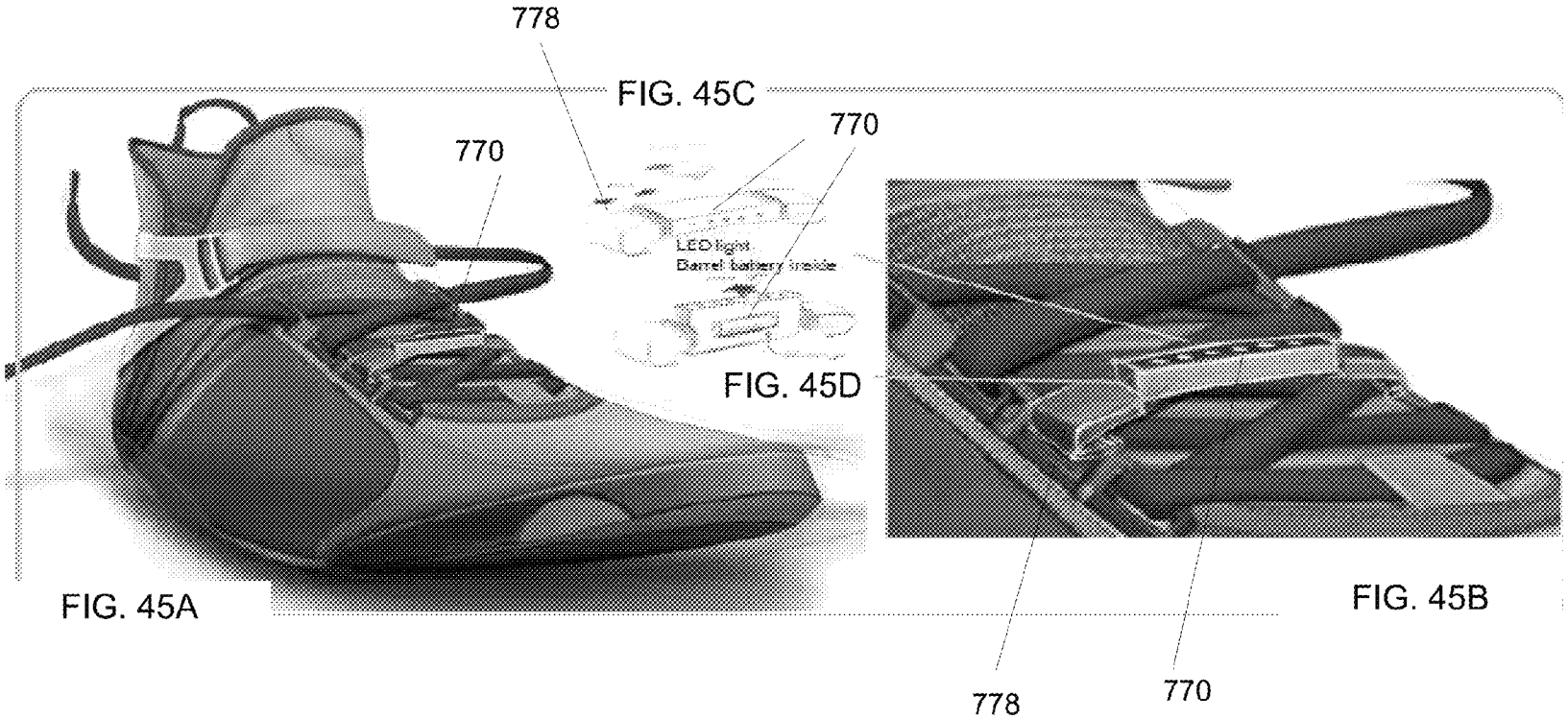
FIG. 45A is an end perspective view of a light housing mounted on a lace attachment element.
FIG. 45B is an end perspective close-up view of the light housing of FIG. 45A.
FIG. 45C is an end perspective view of the light housing of FIG. 45A in a folded-down orientation.
FIG. 45D is an end perspective view of the light housing of FIG. 45A in a folded-up orientation.

FIG. 45A is an end perspective view of a light housing 770 mounted on a lace attachment element 778. FIG. 45B is an end perspective close-up view of the light housing 770 of FIG. 45A. FIG. 45C is an end perspective view of the light housing 770 of FIG. 45A in a folded-down orientation. FIG. 45D is an end perspective view of the light housing 770 of FIG. 45A in a folded-up orientation.

Figure 46:
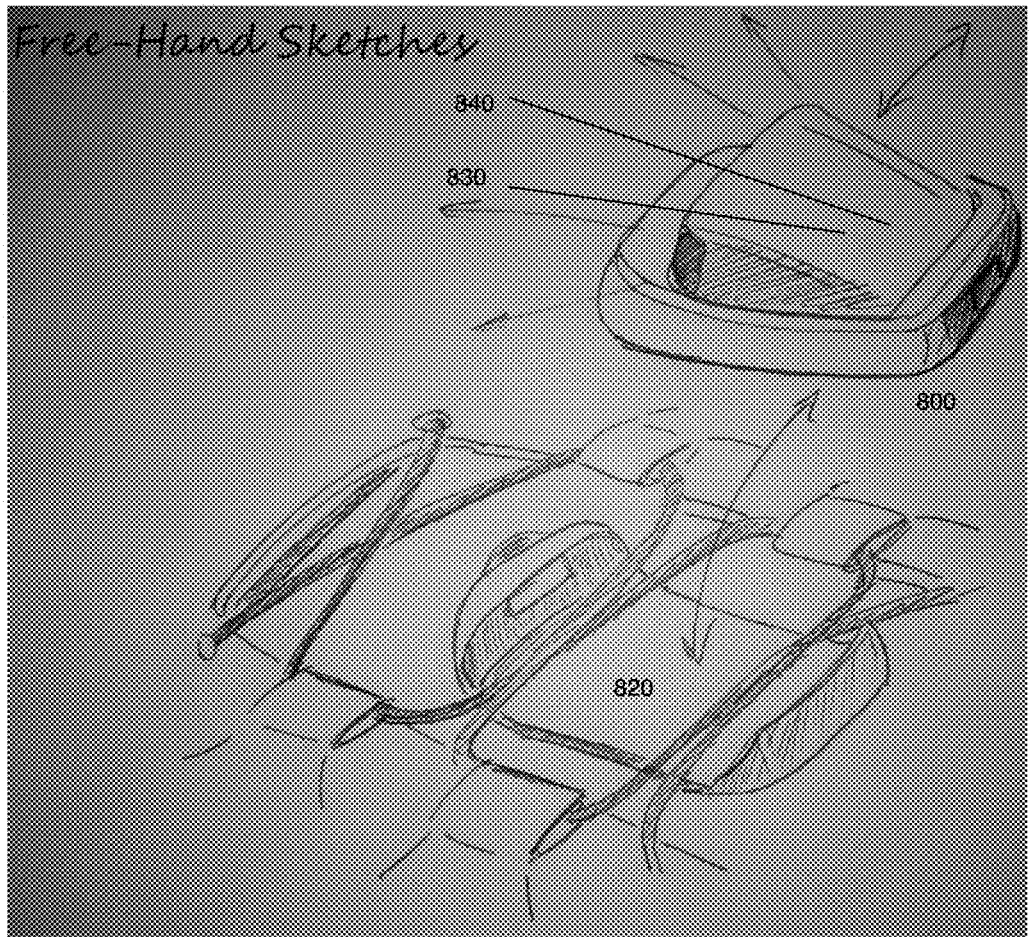
FIG. 46 is an exploded view of a light housing that is contained by a lace attachment element.

FIG. 46 is an exploded view of a light housing 800 that is contained by a lace attachment element 820. In this example, a portion of the light housing may be pivotal and adjustable, or the light housing may be fixed so that the light is projected at an upward angle 840 with respect to the longitudinal axis 830 of the light module.

Bilateral Symmetric Design

Figure 47:
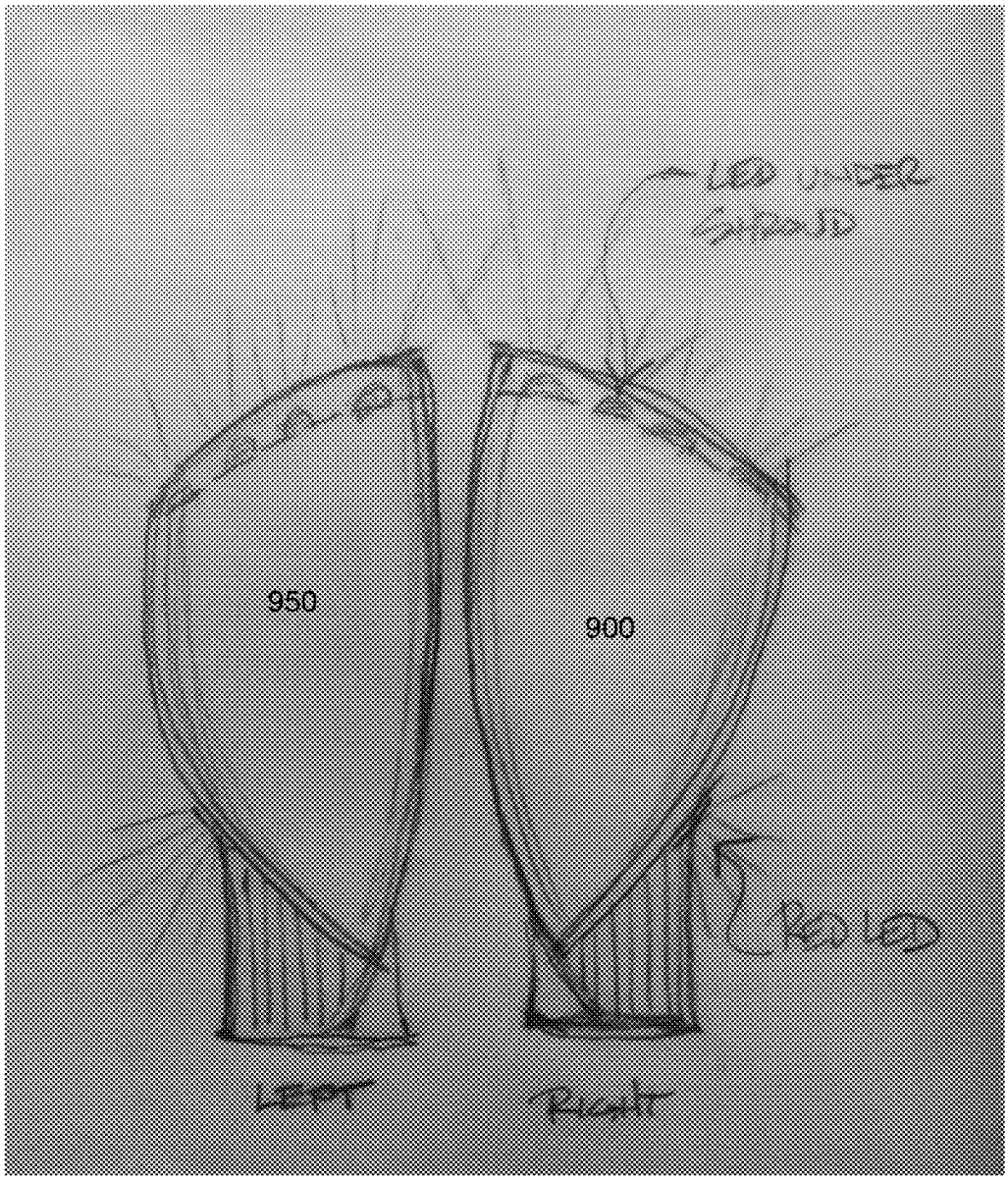
FIG. 47 is a top view of a pair of light housing modules projecting light at different angles.

FIG. 47 is a top view of a pair of light housing modules 900 and 950 projecting light at different angles. Just as the feet have a bilateral symmetry, in this example, there are left and right LED light units that are a mirror image of the other.

The inside edge of each unit 900 and 950 would be pushed forward and contain a larger LED light with a beam that overlaps the opposite units beam. The edge of each light unit would recede back in an arc to mimic the relative proportions of the forward big toe to the smaller end toe. Smaller lights would be along the curve and their overlapping beams would project forward and to the side of the runner or walker.

The rear facing red side markers would be on the outside of the units with their light beams projecting out at a backward and side angle for rear and side visibility. The two units would nest together when off the shoes to form an arc and a bilateral symmetrical design. This "Left-Right Technology" compliments the modern design of running shoes which have a bilateral symmetry.

Figure 48A:
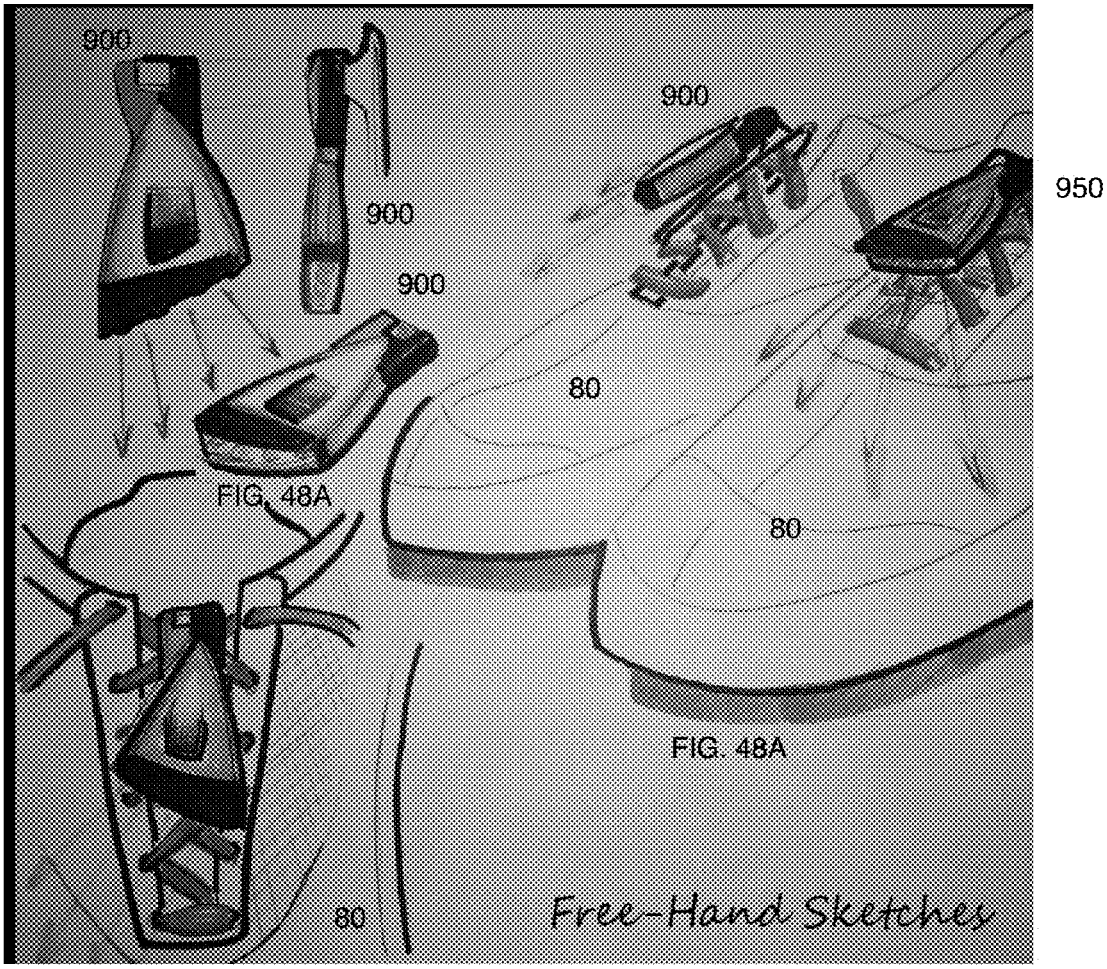
FIG. 48A is a top perspective view of the light housing modules of FIG. 47 mounted on a pair of shoes.
Figures 48B, 48C, 48D:
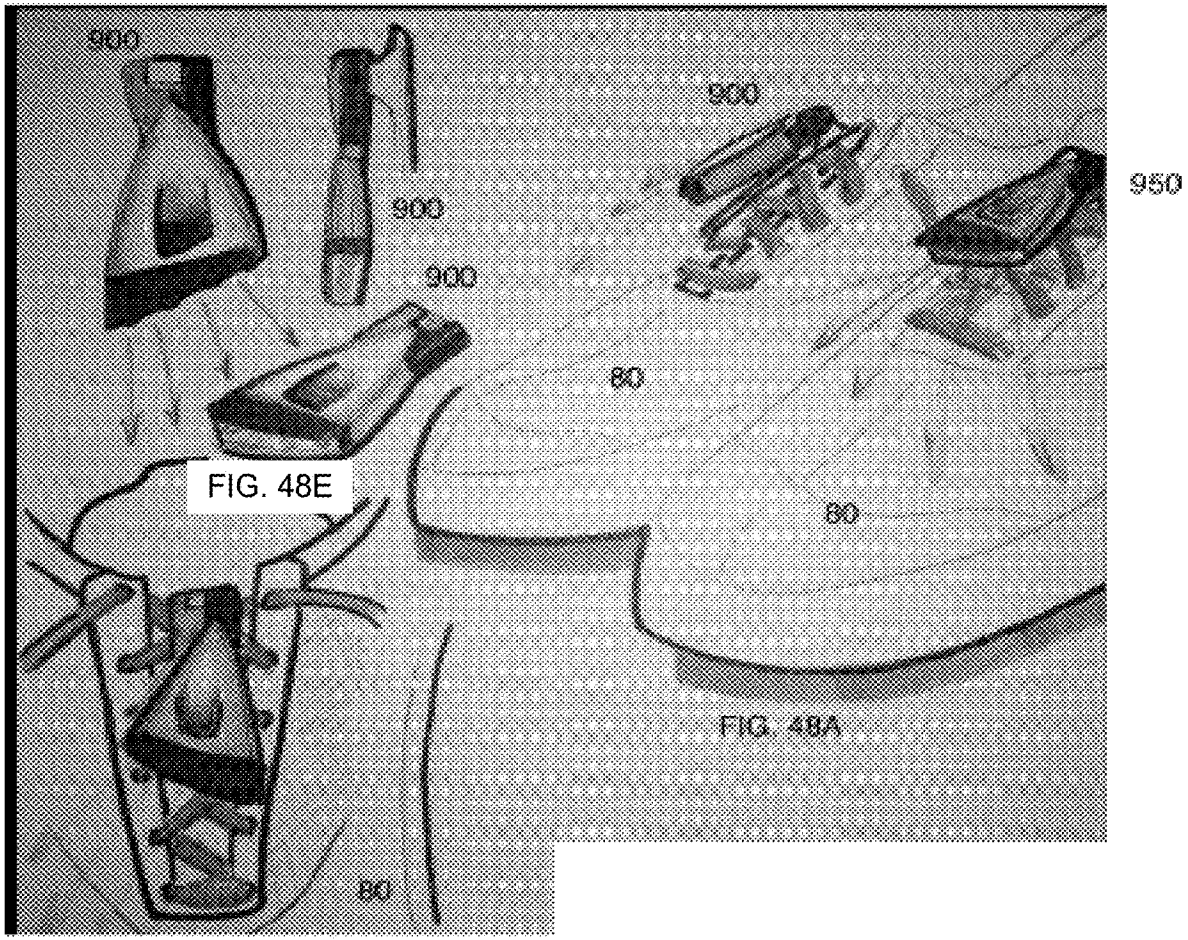
FIG. 48B is a top view of a light housing module of FIG. 47 mounted on a of shoe.
FIGS. 48C, D, E are top, side, and top perspective views of a light housing module of FIG. 47.

FIG. 48A is a top perspective view of the light housing modules of FIG. 47 mounted on a pair of shoes 80 and 81. FIG. 48B is a top view of a light housing module 900 of FIG. 47 mounted on a of shoe 80. FIGS. 48C, D, E are top, side, and top perspective views of a light housing module 900 of FIG. 47.

Rechargeable Battery System

In one example, the light units will be powered by a rechargeable battery system such as a Li-ion rechargeable battery with USB port and wall charger adapter. A "Y" connector can accommodate charging both units at the same time from a standard wall-charging plug in module. In other examples, a charging base will hold both units for ease of charging and non-use storage.

In another example, Kinetic Motion Recharging technology is used to recharge the power supply.

In other examples, motion charging, solar energy, electromagnetic harvesting, or artificial photosynthesis are used to recharge the power supply.

Other Features

In one example, Bluetooth GPS enabled flash interval timers alert runners and walkers to pre determined time or distance milestones.

In one example, remote switching allows runners and walkers to remotely operate light units.

In one example, smart phone integration would provide compatibility with various sport and fitness smart phone applications.

In one example, battery conservation features would be provided, such as the lights switching off when in the up back-kick position.

The light housing may include, a translucent glowing case to enhance design, visibility and desirability.

Flash Interval timers can mark increments of time (such as every 5 minutes, 1 minute, repeat)

A battery level identification can be provided, such as through side red LEDs.

Specialty brackets can be provided fro other sports or activities so that the light housing can be removed from a shoe and used in the bracket.

Shoe Light Systems

In one example, the shoe lights are provided as a kit comprising two shoe lights and a recharging unit.

While exemplary embodiments of the invention have been described, it should be apparent that modifications and variations thereto are possible, all of which fall within the true spirit and scope of the invention. With respect to the above descriptions then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A shoe light system comprising a right shoe light configured to be attachable to a right shoe having a front a right side, and a rear, the right shoe light comprising a right shoe light housing comprising a plurality of LEDs positioned in a right-sidewardly clockwise curved or inclined a front portion, a rear portion, a rechargeable power source, and a first light source comprising a rear light source, such that the rear light source projects light from the right shoe light housing rear portion in a rearward and right side direction a right shoe lace attachment element configured to mount the light housing on the bridge of the right shoe, and a right shoe pivotable connector between the right shoe lace attachment element and the right shoe light housing;

a left shoe light configured to be attachable to a left shoe having a front, a left side, and a rear, the left shoe light comprising a left shoe light housing comprising a plurality of LEDs positioned in a left-sidewardly counter-clockwise curved or inclined a front portion, a rear portion, a rechargeable power source, and a rear light source, such that the rear light source projects light from the left shoe light housing rear portion in a rearward and left side direction a left shoe lace attachment element configured to mount the light housing on the bridge of the left shoe, and a left shoe pivotable connector between the left shoe lace attachment element and the left shoe light housing; such that the right shoe light housing and the left shoe light housing are different shapes and are mirror-images of each other; and a power source recharging unit.

2. The shoe light system of claim 1 wherein the power source recharging unit comprises a dual connector attachable simultaneously to recharging ports in the light housings of the right shoe light and the left shoe light.

3. The shoe light system of claim 1 wherein the power source is a rechargeable lithium-ion battery.

4. The shoe light system of claim 1 wherein the right shoe lace attachment element is a spring clip slide, a torque with clip, a hinge and snap, soft hook and loop strap, fixed mounting plate, rubber friction plate, magnet lock, twist lock screw, spring lock, criss cross, slide lock, top slide lock, hairclip, cross lock, snap lock, living hinge lock, press lock, cam lock, twist lock, or track lock.

5. The shoe light of claim 1 wherein the right shoe pivotal connection is a ball joint, magnet joint, standard hinge, spring hinge, interlocking hinge, clip lock hinge, or metal pivot track.

6. The shoe light of claim 1 wherein the right shoe light housing further comprises a lens.

7. The shoe light of claim 1 wherein the right shoe light housing further comprises an on/off switch.

8. The shoe light of claim 1 wherein the right shoe light housing further comprises a top overhang.

9. The shoe light of claim 1 wherein the right shoe lace attachment element is a clip comprising an upper arm and a lower arm, the upper arm and lower arm connected at a first coupled end and spaced apart at a second gap end, the lower arm positioned below laces in the shoe, the gap end oriented toward the front of the shoe; and the right shoe pivotal connector is provided on the second gap end of the upper arm.

10. The shoe light of claim 1 wherein the right shoe pivotal connector permits the right shoe light housing to be angled upward relative to the front of the shoe.

11. The shoe light of claim 1 wherein the right shoe pivotal connector has a detachment feature to permit removing the right shoe light housing from at least a portion of the right shoe lace attachment element.

12. The shoe light system of claim 2 wherein the recharging ports in the light housings of the right shoe light and the left shoe light are USB ports.

13. The shoe light of claim 7 wherein the right shoe on/off switch is a control button to permit selection of one of a plurality of lighting modes.

14. A method of providing shoe lights on a right shoe, having a front, a right side, and a rear; and on a left shoe, having a front, a left side, and a rear, the method comprising providing a right shoe light comprising a right shoe light housing comprising a right shoe rechargeable power source and a plurality of LEDs positioned in a right-sidewardly clockwise curved or inclined front portion, a rear light source, such that the rear light source projects light from the right shoe light housing rear portion in a rearward and right side direction, a right shoe lace attachment element, and a right shoe pivotable connector between the lace attachment element and the light housing;

attaching the right shoe light to a right shoe by securing the right shoe lace attachment element to laces on the first shoe, such that the right shoe light source provides a light in the direction of the front of the right shoe, adjusting the right shoe pivotal connector to a desired angle relative to the right shoe lace attachment element;

providing a left shoe light comprising a left shoe light housing, different in shape from, and a mirror image of, the right shoe housing, the left shoe light housing comprising a rechargeable power source and a plurality of LEDs positioned in a left-sidewardly counter-clockwise curved or inclined front portion, a rear light source, such that the rear light source projects light from the left shoe light housing rear portion in a rearward and left side direction, a left shoe lace attachment element; and attaching the left shoe light to a second shoe by securing the left shoe lace attachment element to laces on the left shoe, such that the left shoe light source provides a light in the direction of the front of the left shoe, adjusting the left shoe pivotal connector to a desired angle relative to the left shoe lace attachment element;

turning on the right shoe light source and left shoe light source while walking or running with the shoe.

15. The method of claim 14 further comprising removing the right shoe and left shoe light housings from at least a portion of the right shoe and left shoe lace attachment elements; and recharging the power sources.

* * * * *